US008696088B2

(12) United States Patent
Takada et al.

(10) Patent No.: US 8,696,088 B2
(45) Date of Patent: Apr. 15, 2014

(54) NOZZLE SURFACE CLEANING APPARATUS, MAINTENANCE METHOD USING SAME, AND DROPLET EJECTION APPARATUS

(75) Inventors: Norihisa Takada, Kanagawa (JP); Hiroshi Inoue, Kanagawa (JP); Tsutomu Yokouchi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 69 days.

(21) Appl. No.: 13/220,403

(22) Filed: Aug. 29, 2011

(65) Prior Publication Data

US 2012/0050394 A1 Mar. 1, 2012

(30) Foreign Application Priority Data

Aug. 31, 2010 (JP) ..... 2010-194588
Mar. 8, 2011 (JP) ..... 2011-050595

(51) Int. Cl.
*B41J 2/165* (2006.01)

(52) U.S. Cl.
USPC ..... 347/33; 347/22; 347/27

(58) Field of Classification Search
USPC ..... 347/33, 22, 27
See application file for complete search history.

(56) References Cited

U.S. PATENT DOCUMENTS

2004/0165031 A1 8/2004 Nishi et al.
2005/0162461 A1* 7/2005 Fujimori et al. ..... 347/33

FOREIGN PATENT DOCUMENTS

JP 11-314374 A 11/1999
JP 2003-266717 A 9/2003
JP 2005-28758 A 2/2005
JP 2005-74671 A 3/2005
JP 2007-130807 A 5/2007
JP 2009-226610 A 10/2009

OTHER PUBLICATIONS

Japanese Office Action issued on Dec. 9, 2013 in corresponding Application No. 2011-050595.

* cited by examiner

*Primary Examiner* — Henok Legesse
(74) *Attorney, Agent, or Firm* — Birch, Stewart, Kolasch & Birch, LLP

(57) ABSTRACT

A nozzle surface cleaning apparatus wipes a nozzle surface of a droplet ejection head. The apparatus includes: a wiping member which wipes the nozzle surface in which a nozzle aperture is formed; a head movement device which causes movement of the droplet ejection head in a head movement plane and in a head movement direction; and a fine vibration device which causes vibration of one of the wiping member and the droplet ejection head in a vibration plane and in a vibration direction, the vibration plane being parallel to the head movement plane, the vibration direction being different to the head movement direction.

41 Claims, 28 Drawing Sheets

NOZZLE SURFACE CLEANING APPARATUS, MAINTENANCE METHOD USING SAME, AND DROPLET EJECTION APPARATUS

BACKGROUND OF THE INVENTION

1. Field of the Invention

The present invention relates to a nozzle surface cleaning apparatus, a maintenance method using same, and a droplet ejection apparatus, and more particularly to a nozzle surface cleaning apparatus which wipes a nozzle surface by pressing a wiping member against the nozzle surface, a maintenance method using same, and a droplet ejection apparatus.

2. Description of the Related Art

In an inkjet head of an inkjet recording apparatus, foreign matter of various types, such as ink residue, paper dust, or the like, adheres to the nozzle surface and the nozzle edges of the inkjet head with use. When foreign matter adheres to the nozzle surface, ink droplets ejected from the nozzles are affected, variation occurs in the ejection direction of the ink droplets, it becomes difficult to deposit the ink droplets at the prescribed positions on the recording medium, and this becomes a cause of decline in the image quality. Hence, in an inkjet recording apparatus, it is important to remove foreign matter periodically by means of a maintenance method, such as wiping, a dummy jet action, or the like.

For example, Japanese Patent Application Publication No. 2005-074671 describes removing foreign matter by placing a rotatable brush in contact with the nozzle surface of the head, and moving the brush reciprocally in an advancing and retracting direction and a parallel direction with respect to the nozzle surface. Japanese Patent Application Publication No. 2003-266717 describes removing foreign matter by placing a cleaning roller in contact with the ink ejection surface, moving the roller relatively to the ink ejection surface, and controlling the movement speed and rotational speed of the cleaning roller. Japanese Patent Application Publication No. 2005-028758 describes spraying cleaning liquid to which an ultrasonic wave is applied, and cleaning the interior of ink nozzles by means of pressure and the ultrasonic wave.

Moreover, Japanese Patent Application Publication No. 11-314374 discloses an inkjet recording apparatus which includes a wiping member (blade) having a structure which is able to turn in a range of 90 degrees on the nozzle surface, and which executes a first wiping operation of wiping the nozzle plate in a first direction and a second wiping operation of wiping in the direction perpendicular to the first direction.

Further, Japanese Patent Application Publication No. 2007-130807 discloses an inkjet recording apparatus which includes a wiping member for wiping ink adhering to the ejection surface and an absorbing member for absorbing the ink adhering to the ejection surface, the inkjet recording apparatus being composed so as to move the absorbing member in a direction substantially perpendicular to the wiping direction of the wiping member.

Furthermore, Japanese Patent Application Publication No. 2009-226610 discloses a recording apparatus which moves a wiper member reciprocally in a direction perpendicular to the main scanning direction, as well as swinging the wiper member about an axis extending in a direction perpendicular to the ink ejection surface in a plane parallel to the ink ejection surface, and thereby seeking to increase the lifespan of the wiper member.

However, in a case where wiping is performed in the perpendicular direction to the nozzle surface while generating vibration, as described in Japanese Patent Application Publication No. 2005-074671, there is a problem in that damage is caused to the nozzle surface and the liquid repellent film formed on the nozzle surface is broken down. Moreover, the method described in Japanese Patent Application Publication No. 2003-266717 performs the wiping in one direction, and although the foreign matter can be removed by wiping in one direction if the foreign matter is easily removable (if the foreign matter is not adhering very strongly to the nozzle surface), only a portion of the foreign matter can be removed completely by wiping in one direction, if the foreign matter is difficult to remove. The method described in Japanese Patent Application Publication No. 2005-028758 is not adequate due to only performing the cleaning with the cleaning liquid to which the ultrasonic wave is applied. Consequently, in these maintenance methods, there is a problem in that the ejection direction cannot be restored.

Apart from the problems described above, problems such as those described below also exist. FIG. 29A shows a schematic view of a state where ink 604 has adhered to a nozzle surface 602 of an inkjet head 600. The ink 604 shown in FIG. 29A becomes solidified to material firmly adhering to the nozzle surface 602 when drying and increasing in viscosity with the passage of time.

FIG. 29B shows a state where the ink 604 adhering to the nozzle surface 602 has solidified. In this state, cleaning liquid is applied to the nozzle surface 602, and FIG. 29C shows a state where the nozzle surface 602 is wiped using a wiping web 606.

The wiping web 606 wipes the nozzle surface 602 while pulling and extending the ink of increased viscosity adhering to the nozzle surface 602. If the wiping by the wiping web 606 is performed in one direction only, then as shown FIG. 29D, adhering material 610 remains inside the nozzle 608 on the leading edge thereof in the direction of travel of the inkjet head 600 (the direction indicated by the arrow in the drawing) (i.e., the edge on the upstream side in terms of the direction of travel of the wiping web 606).

If adhering material is present inside the nozzle 608 or in the vicinity of the nozzle 608 on the nozzle surface 602, then variation occurs in the ejection direction of the droplets ejected from the nozzle 608, as described previously.

Japanese Patent Application Publication No. 11-314374 discloses a wiping member (blade) having a structure which is rotatable in a range of 90° on the nozzle surface, but does not disclose a specific wiping method (conditions).

The absorbing member disclosed in Japanese Patent Application Publication No. 2007-130807 serves to absorb ink which has adhered to the ejection surface, but beneficial effects in removing solid adhering material cannot be expected. Furthermore, the composition disclosed in Japanese Patent Application Publication No. 2007-130807 performs wiping substantially in one direction with respect to the ejection ports, and beneficial effects in removing hard adhering material cannot be expected.

The recording apparatus disclosed in Japanese Patent Application Publication No. 2009-226610 also performs wiping substantially in one direction with respect to the nozzle openings, and has difficulty in removing hard adhering material.

SUMMARY OF THE INVENTION

The present invention has been contrived in view of these circumstances, an object thereof being to provide a nozzle surface cleaning apparatus, a maintenance method using same, and a droplet ejection apparatus capable of efficiently wiping away foreign matter, such as ink residue, which has adhered to the nozzles.

In order to attain the aforementioned object, the present invention is directed to a nozzle surface cleaning apparatus which wipes a nozzle surface of a droplet ejection head, the apparatus comprising: a wiping member which wipes the nozzle surface in which a nozzle aperture is formed; a head movement device which causes movement of the droplet ejection head in a head movement plane and in a head movement direction; and a fine vibration device which causes vibration of one of the wiping member and the droplet ejection head in a vibration plane and in a vibration direction, the vibration plane being parallel to the head movement plane, the vibration direction being different to the head movement direction.

According to this aspect of the present invention, it is possible to perform wiping in a plurality of directions by causing the vibration in the same plane as, and the different direction to, the movement of the droplet ejection head by the movement device, by means of the fine vibration generating device. Consequently, it is possible efficiently to remove foreign matter which has been difficult to wipe away by means of wiping in one direction only.

More specifically, since the wiping can be performed in the different direction also by means of the vibration device, in addition to the wiping by relative movement of the droplet ejection head and the wiping member, then it is possible efficiently to remove foreign matter which is adhering to the nozzles.

Preferably, the vibration direction is substantially perpendicular to the head movement direction.

According to this aspect of the present invention, the direction of vibration by the fine vibration device is the substantially perpendicular direction with respect to the movement by the head movement device, and therefore it is possible to remove foreign matter more efficiently.

Preferably, a frequency f of the vibration satisfies: $f \geq Vh/(2\times(Ln+Lw))$, where Vh is a speed of the movement of the droplet ejection head, Ln is a dimension of the nozzle aperture in a direction of travel of the wiping member, and Lw is a dimension of abutment of the wiping member with the nozzle surface in the head movement direction.

According to this aspect of the present invention, by setting the frequency of the fine vibration device to the range described above, it is possible to perform fine vibration at the frequency corresponding to the size of the nozzles, and therefore it is possible to remove foreign matter efficiently.

Preferably, an amplitude of the vibration is not less than a dimension of the nozzle aperture in a direction perpendicular to the head movement direction.

According to this aspect of the present invention, the amplitude of vibration is not less than the width of the nozzles in the perpendicular direction with respect to the direction of movement of the head device, and therefore it is possible to wipe out foreign matter inside the nozzles.

Preferably, the wiping member is a band-shaped web.

According to this aspect of the present invention, since the wiping member is the band-shaped web, then it is possible to wipe the nozzle surface with a new web at all times. Consequently, it is possible to continue wiping by vibration, even if the web itself is damaged.

Preferably, the nozzle surface cleaning apparatus further comprises: a pressing member which presses the wiping member against the nozzle surface; a wiping member movement device which causes movement of the wiping member in a wiping member movement direction and includes: a pay-out spindle which pays out the wiping member; a take-up spindle which takes up the wiping member; and a drive roller which is driven to rotate and conveys, toward the take-up spindle, the wiping member which is wrapped about the pay-out spindle, the pressing member and the take-up spindle; and a main body frame in which the wiping member, the pressing member and the wiping member movement device are arranged.

According to this aspect of the present invention, the wiping member is conveyed from the pay-out spindle to the take-up spindle, and therefore it is possible to carry out wiping using a new wiping material at all times.

Preferably, the fine vibration device includes a vibration application member which causes at least one of the pressing member and the main body frame to vibrate.

According to this aspect of the present invention, since the fine vibration device is a device which causes the pressing member or the main body frame to vibrate, then it is possible to cause the wiping member to vibrate readily. Furthermore, when there is a plurality of nozzle surfaces, if the pressing member is vibrated, then it is possible to control vibration thereof separately. It is also possible to cause the wiping member to vibrate by vibrating the main body frame on which the respective members are arranged.

Preferably, the vibration application member includes a piezoelectric actuator.

It is also preferable that the vibration application member includes an eccentric cam and a motor rotating the eccentric cam.

It is also preferable that the vibration application member includes a linear motor.

Preferably, the wiping member movement direction is same with the head movement direction; and the nozzle surface cleaning apparatus further comprises a control unit which carries out wiping of the nozzle surface by the wiping member at least once under each of a condition where a speed of the movement of the droplet ejection head is higher than a speed of the movement of the wiping member, and a condition where the speed of the movement of the wiping member is higher than the speed of the movement of the droplet ejection head.

According to this aspect of the present invention, the direction of movement of the droplet ejection head and the direction of movement of the wiping member are the same direction, and the speed of movement of the droplet ejection head and the speed of movement of the wiping member are different. If the speed of movement of the droplet ejection head is faster, then the wiping direction becomes a direction opposite to the direction of movement of the droplet ejection head, and if the speed of movement of the wiping member is faster, then the wiping direction becomes the same direction as the direction of movement of the droplet ejection head. Consequently, by carrying out wiping at least once under each of these conditions, and also carrying out fine vibration by means of the fine vibration device, it is possible to perform wiping in different directions and removal of foreign matter can be carried out efficiently.

Preferably, the nozzle surface cleaning apparatus further comprises: a pair of cleaning liquid spraying units which spray cleaning liquid to the nozzle surface and are arranged both sides of a position of wiping of the nozzle surface by the wiping member in terms of the head movement direction; and a control unit which carries out the wiping of the nozzle surface by the wiping member at least once under each of a condition where the head movement direction and the wiping member movement direction are set to be opposite to each other, and a condition where the head movement direction and the wiping member movement direction are set to be same with each other and a speed of the movement of the droplet ejection head is higher than a speed of the movement of the wiping member.

According to this aspect of the present invention, wiping is performed at least once under each of the condition where the direction of movement of the droplet ejection head and the direction of movement of the wiping member are opposite directions, and the condition where the direction of movement of the droplet ejection head and the direction of movement of the wiping member are the same direction and the speed of movement of the droplet ejection head is faster. If the direction of movement is different, the wiping direction is opposite to the direction of movement of the droplet ejection head. If the movement direction is the same and the speed of movement of the droplet ejection head is faster, then the wiping direction is opposite to the direction of movement of the droplet ejection head. Consequently, by changing the direction of movement of the droplet ejection head, and also carrying out fine vibration by means of a fine vibration device, it is possible to perform wiping in different directions and removal of foreign matter can be carried out efficiently.

Preferably, the nozzle surface cleaning apparatus further comprises a cleaning liquid spraying unit which sprays cleaning liquid to the nozzle surface and is arranged before a position of wiping of the nozzle surface by the wiping member in terms of the head movement direction.

According to this aspect of the present invention, it is possible to remove foreign matter more efficiently by applying the cleaning liquid.

Preferably, the nozzle surface cleaning apparatus further comprises an ultrasonic wave application device which applies an ultrasonic wave to the cleaning liquid sprayed by the cleaning liquid spraying unit.

According to this aspect of the present invention, since an ultrasonic wave is applied to the cleaning liquid which is deposited before carrying out wiping, then it is possible to remove foreign matter even more easily.

Preferably, a frequency of the ultrasonic wave is not lower than 700 kHz.

According to this aspect of the present invention, since the frequency of the ultrasonic wave is not lower than 700 kHz, then it is possible to perform ejection of cleaning liquid to which an ultrasonic wave is applied, while reducing damage to the nozzles.

Preferably, a spraying angle of the cleaning liquid with respect to the nozzle surface is controlled in accordance with a tapering angle of the nozzle aperture.

According to this aspect of the present invention, since the spraying angle of the cleaning liquid coincides with the tapering angle of the nozzles, then it is possible to supply the cleaning liquid to the interior of the nozzles, and therefore hidden foreign matter in the taper of the nozzles can be removed.

Preferably, the fine vibration device causes a reciprocal movement of the at least one of the wiping member and the droplet ejection head in forth and back movements in the vibration direction at least once while the droplet ejection head is moved by a dimension of abutment of the wiping member with the nozzle surface in the head movement direction.

According to this aspect of the present invention, by moving the wiping member back and forth at least once in the different direction which is substantially perpendicular to the direction of movement of the droplet ejection head, when wiping the nozzle surface, then the nozzle surface is wiped in a plurality of directions and foreign matter adhering to the nozzle surface can be removed reliably.

A desirable mode is one where at least one nozzle is included in the abutment width. Furthermore, desirably, at least one nozzle passes during the reciprocal movement in the different direction.

Preferably, an amount of one of the forth and back movements satisfies a condition where an angle between the head movement direction and the vibration direction is not less than 90°.

Preferably, an amount A of one of the forth and back movements, a speed V of the movement of the droplet ejection head, the dimension Lw of the abutment of the wiping member with the nozzle surface in the head movement direction, and a frequency f of the vibration satisfy: $f>V/Lw$; and $A>(Vw+Vh)/(2\times\pi\times f)$.

Preferably, the wiping member is a sheet-shaped web having absorbing characteristics with respect to liquid; and the nozzle surface cleaning apparatus further comprising a pressing member which has a surface that deforms elastically and is in contact with the web to press the web against the nozzle surface by pressing the web from a side of the web opposite to a side of the web that is in contact with the nozzle surface.

According to this aspect of the present invention, by pressing the wiping member against the nozzle surface, the adhering material which is adhering to the nozzle surface can be removed reliably.

In this mode, desirably, the apparatus is provided with an impelling member which impels the pressing member.

Preferably, the pressing member includes an elastic roller having a roller shape of which a surface is provided with an elastic member.

For the elastic roller in the present mode, it is possible to use a rubber roller having a rubber material of a prescribed hardness wrapped about the surface.

Preferably, the fine vibration device causes a reciprocal movement of the at least one of the wiping member and the droplet ejection head in forth and back movements in the vibration direction at least once while the droplet ejection head is moved by a dimension of abutment of the wiping member with the nozzle surface in the head movement direction; and an amount of one of the forth and back movements is not less than a width of a weave of the web.

Preferably, a static coefficient of friction between the web and the pressing member exceeds a slipping coefficient of friction between the nozzle surface and the web.

According to this aspect of the present invention, slipping does not occur between the web and the pressing member, while slipping does occur between the nozzle surface and the web, and therefore adhering material on the nozzle surface can be removed reliably.

In order to attain the aforementioned object, the present invention is also directed to a droplet ejection apparatus, comprising: an droplet ejection head which ejects droplets to a recording medium; and the above-described nozzle surface cleaning apparatus.

The nozzle surface cleaning apparatus according to the present invention can be used suitably for wiping the nozzle surface of the droplet ejection head, and can therefore be used appropriately in the droplet ejection apparatus.

In order to attain the aforementioned object, the present invention is also directed to a maintenance method for a droplet ejection head having a nozzle surface in which a nozzle aperture is formed, the method comprising: a head movement step of causing movement of the droplet ejection head in a head movement plane and in a head movement direction; a wiping member movement step of causing movement of the wiping member in a wiping member movement direction to perform wiping of the nozzle surface with the wiping member; and a fine vibration step of causing vibration of one of the wiping member and the droplet ejection head in a vibration plane and in a vibration direction, the vibration plane being parallel to the head movement plane, the vibration direction being different to the head movement direction.

According to this aspect of the present invention, since there is the fine vibration step which applies vibration to the droplet ejection head or the wiping member, causing same to vibrate in the same plane and a different direction, then it is possible to carry out wiping in a plurality of directions. Consequently, it is possible efficiently to remove foreign matter which has been difficult to wipe away by means of wiping in one direction only.

Preferably, the wiping member movement direction is same with the head movement direction; the head movement step and the wiping member movement step include a first step where a speed of the movement of the droplet ejection head is higher than a speed of the movement of the wiping member, and a second step where the speed of the movement of the wiping member is higher than the speed of the movement of the droplet ejection head; and the wiping of the nozzle surface with the wiping member is performed at least once while each of the first step and the second step.

Preferably, the head movement step and the wiping member movement step include a first step where the head movement direction and the wiping member movement direction are set to be opposite to each other, and a second step where the head movement direction and the wiping member movement direction are set to be same with each other and a speed of the movement of the droplet ejection head is higher than a speed of the movement of the wiping member; and the wiping of the nozzle surface with the wiping member is performed at least once while each of the first step and the second step.

According to these aspects of the present invention, it is possible to remove foreign matter in different wiping directions, as well as causing fine vibrations by the fine vibration step, and therefore wiping can be performed in different directions and foreign matter can be removed efficiently.

Preferably, the maintenance method further comprises a detection step of detecting soiling of the nozzle surface, wherein the fine vibration step is performed in accordance with the soiling detected in the detection step.

According to this aspect of the present invention, soiling is detected and the fine vibration step is performed in accordance with the detected soiling. The liquid repellent film on the nozzle surface may be degraded and damage may be caused to the nozzle edges, by wiping the nozzle surface. Consequently, by carrying out wiping by applying vibration only to portions where there is severe soiling, then it is possible to reduce the damage caused to the nozzle surface.

Preferably, the detection step includes the step of checking an image formed by ejecting fluid from the nozzle surface.

It is also preferable that the detection step includes the step of checking the nozzle surface with a camera.

Preferably, the fine vibration step includes the step of causing a reciprocal movement of the at least one of the wiping member and the droplet ejection head in forth and back movements in the vibration direction at least once while the droplet ejection head is moved by a dimension of abutment of the wiping member with the nozzle surface in the head movement direction.

Preferably, an amount of one of the forth and back movements satisfies a condition where an angle between the head movement direction and the vibration direction is not less than 90°.

Preferably, an amount A of one of the forth and back movements, a speed V of the movement of the droplet ejection head, the dimension Lw of the abutment of the wiping member with the nozzle surface in the head movement direction, and a frequency f of the vibration satisfy: $f>V/Lw$; and $A>(Vw+Vh)/(2\times\pi\times f)$.

Preferably, the wiping member is a sheet-shaped web having absorbing characteristics with respect to liquid; and the wiping member is pressed by a pressing member which has a surface that deforms elastically and is in contact with the web to press the web against the nozzle surface by pressing the web from a side of the web opposite to a side of the web that is in contact with the nozzle surface.

Preferably, the pressing member includes an elastic roller having a roller shape of which a surface is provided with an elastic member.

Preferably, the fine vibration step includes the step of causing a reciprocal movement of the at least one of the wiping member and the droplet ejection head in forth and back movements in the vibration direction at least once while the droplet ejection head is moved by a dimension of abutment of the wiping member with the nozzle surface in the head movement direction; and an amount of one of the forth and back movements is not less than a width of a weave of the web.

Preferably, a static coefficient of friction between the web and the pressing member exceeds a slipping coefficient of friction between the nozzle surface and the web.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Here, a nozzle surface cleaning apparatus, a maintenance method using same, and an inkjet recording apparatus as an embodiment of a droplet ejection apparatus, according to embodiments of the present invention are described.

Composition of Image Recording Unit of Inkjet Recording Apparatus

Figure 1:
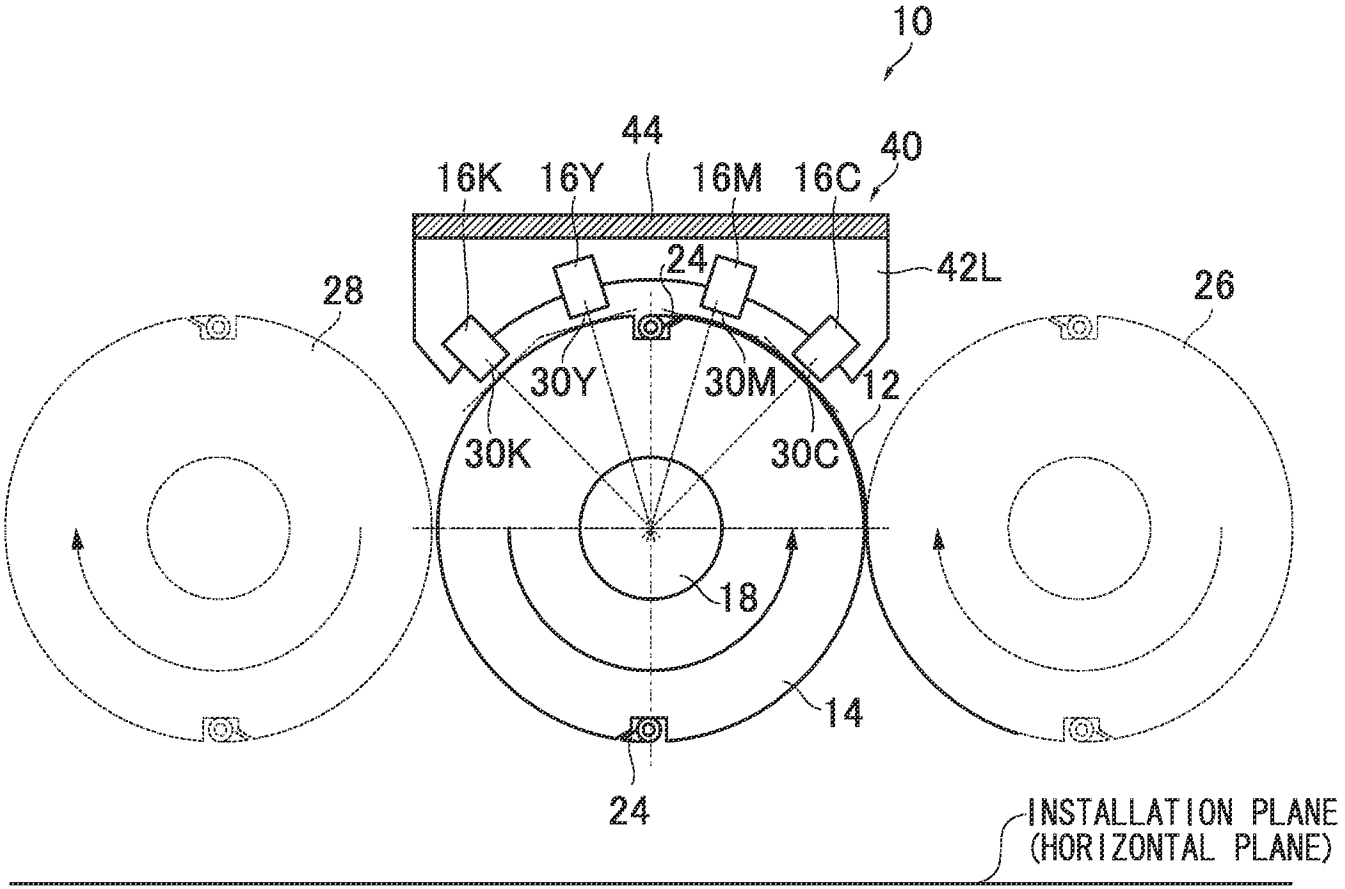
FIG. 1 is a side view diagram showing the general composition of an image recording unit of an inkjet recording apparatus.

FIG. 1 is a side view diagram showing the general composition of an image recording unit of an inkjet recording apparatus.

As shown in FIG. 1, the image recording unit 10 of the inkjet recording apparatus according to the present embodiment conveys a recording medium (cut sheet of paper) 12 by means of an image recording drum 14. Droplets of inks of respective colors of cyan (C), magenta (M), yellow (Y), black (K) are ejected and deposited on a surface of the recording medium 12 from inkjet heads (droplet ejection heads) 16C, 16M, 16Y and 16K, which are arranged about the periphery of the image recording drum 14, whereby a color image is recorded on the surface of the recording medium 12.

Figure 2:
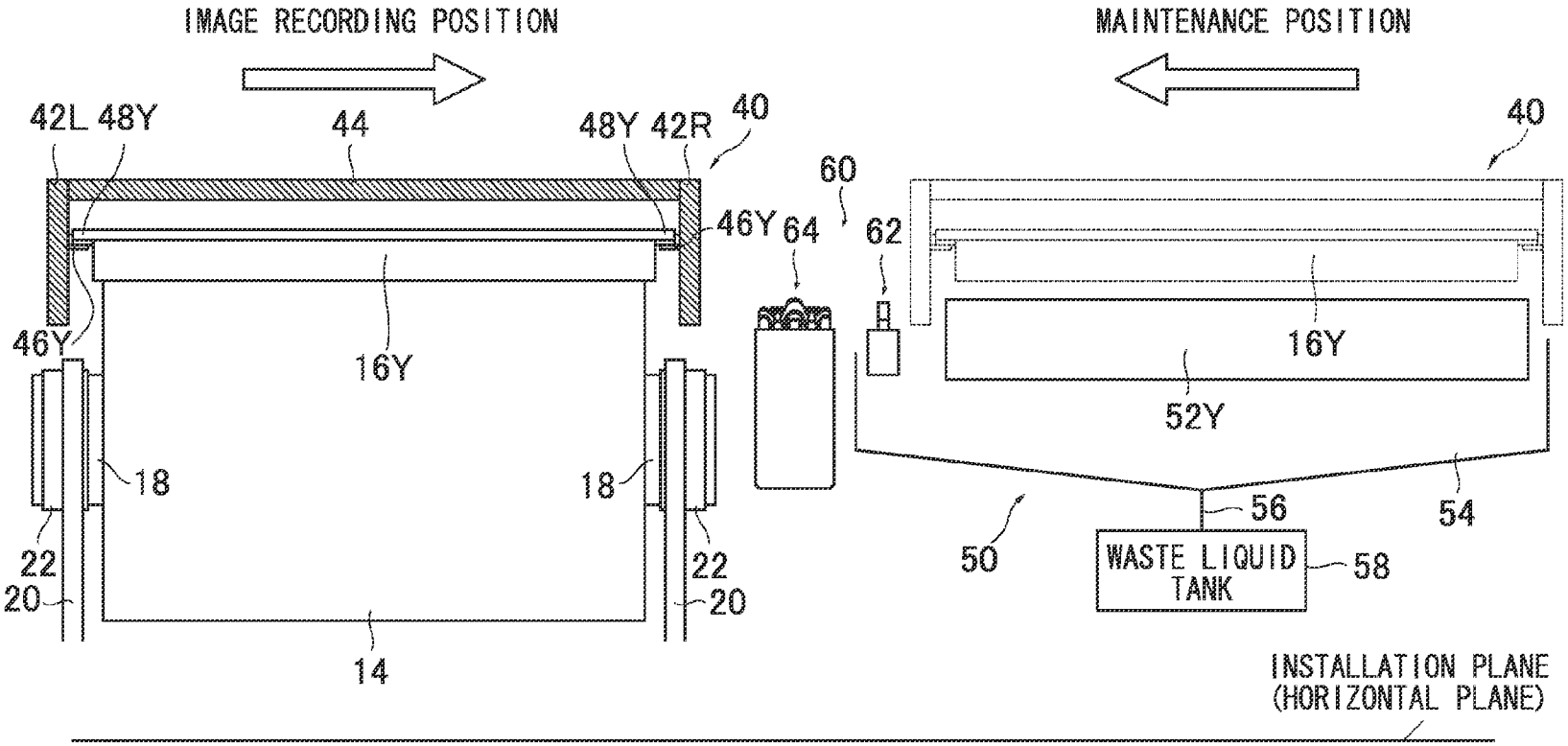
FIG. 2 is a front view diagram of the image recording unit of the inkjet recording apparatus.

The image recording drum 14 is arranged rotatably, and end portions of a rotating shaft 18 of the image recording drum 14 are supported on a pair of bearings 22 (see FIG. 2). The bearings 22 are arranged on a main frame 20 of the inkjet recording apparatus, and due to the end portions of the rotating shaft 18 being supported on this pair of bearings 22, the image recording drum 14 is installed horizontally (the rotating shaft 18 is installed in parallel with the horizontal installation surface).

A motor is coupled to the rotating shaft 18 of the image recording drum 14 through a rotation transmission mechanism (not illustrated). The image recording drum 14 is driven by the motor to rotate.

The image recording drum 14 is provided with grippers 24 arranged on the circumferential surface thereof (in the present embodiment, at two locations on the outer circumferential surface thereof) so as to grip a leading end portion of the recording medium 12. The leading end portion of the recording medium 12 is gripped by the grippers 24 and thereby held on the outer circumferential surface of the image recording drum 14.

The image recording drum 14 is further provided with an attraction holding mechanism which is not illustrated (for example, an electrostatic attraction mechanism or a vacuum suction mechanism). The recording medium 12 which is wrapped about the outer circumferential surface of the image recording drum 14 and the leading end portion of which is gripped by the gripper 24 is held by attraction on the rear surface side thereof by the attraction holding mechanism and thereby held on the outer circumferential surface of the image recording drum 14.

In the inkjet recording apparatus according to the present embodiment, the recording medium 12 is transferred to the image recording drum 14 through a conveyance drum 26 from a previous step. The conveyance drum 26 is disposed in parallel with the image recording drum 14 and transfers the recording medium 12 onto the image recording drum 14 in a synchronized fashion.

Furthermore, the recording medium 12 after the image recording is transferred to a subsequent step through a conveyance drum 28. The conveyance drum 28 is disposed in parallel with the image recording drum 14 and receives the recording medium 12 from the image recording drum 14 in a synchronized fashion.

The four inkjet heads 16C, 16M, 16Y and 16K are constituted of line heads having widths corresponding to the width of the recording medium, and are arranged at uniform intervals apart radially on a circle concentric with the rotating shaft 18 of the image recording drum 14.

In the present embodiment, the four inkjet heads 16C, 16M, 16Y and 16K are arranged horizontally symmetrically about the image recording drum 14. In other words, the cyan inkjet head 16C and the black inkjet head 16K are disposed symmetrically with respect to the vertical line that passes through the center of the image recording drum 14, and the magenta inkjet head 16M and the yellow inkjet head 16Y are also disposed horizontally symmetrically with respect to the same vertical line.

Nozzle surfaces 30C, 30M, 30Y and 30K, which are formed at lower ends of the inkjet heads 16C, 16M, 16Y and 16K disposed as described above, are positioned so as to face the outer circumferential surface of the image recording drum 14, and the nozzle surfaces 30C, 30M, 30Y and 30K are disposed at a prescribed height position from the outer circumferential surface of the image recording drum 14 (a uniform gap is formed between the outer circumferential surface of the image recording drum 14 and each of the nozzle surfaces 30C, 30M, 30Y and 30K). Furthermore, inkjet nozzles are formed in the nozzle surfaces 30C, 30M, 30Y and 30K, and are arranged in rows perpendicular to the conveyance direction of the recording medium 12.

Ink droplets are ejected perpendicularly toward the outer circumferential surface of the image recording drum 14 from the nozzles which are formed on the nozzle surfaces 30C, 30M, 30Y and 30K of the inkjet heads 16C, 16M, 16Y, 16K disposed as described above.

Figure 3:
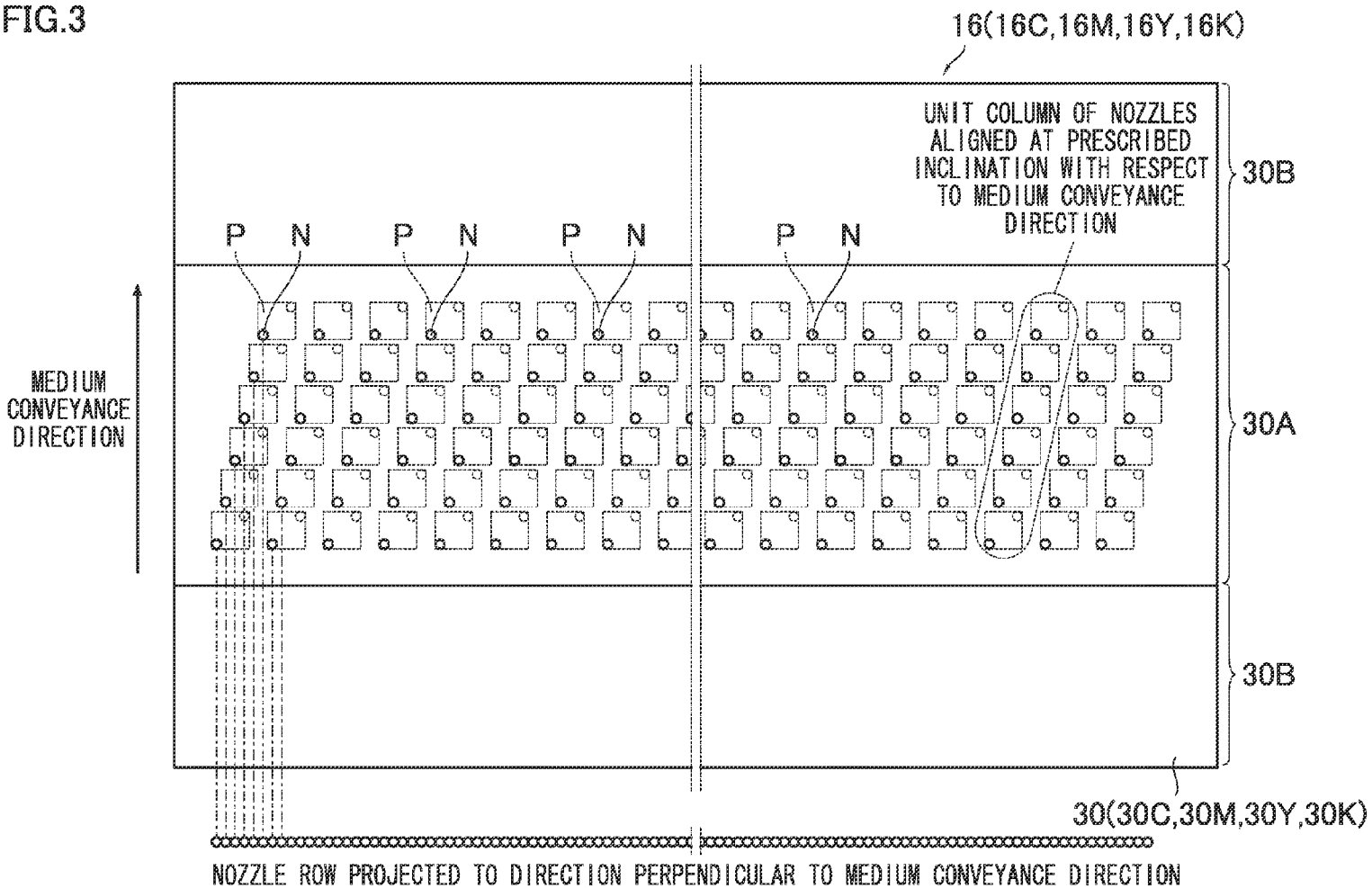
FIG. 3 is a plan view perspective diagram of a nozzle surface of an inkjet head.

FIG. 3 is a plan view perspective diagram of the nozzle surface of the inkjet head.

The inkjet heads 16C, 16M, 16Y and 16K have the same composition, and therefore the composition of one inkjet head 16 and the nozzle surface 30 (30C, 30M, 30Y, 30K) thereof is described here.

As shown in FIG. 3, the nozzle surface 30 is formed in a rectangular shape and includes a nozzle forming region 30A having a fixed width in the central portion of the breadthwise direction thereof (media conveyance direction) and nozzle protecting regions 30B arranged symmetrically on either side of the nozzle forming region 30A.

The nozzle forming region 30A is a region where nozzles are formed and a prescribed liquid repelling treatment is applied on the surface of this region (a liquid repelling film is applied thereon).

Here, as shown in FIG. 3, the inkjet head 16 according to the present embodiment is composed as a so-called matrix head and nozzles N are arranged in a two-dimensional matrix configuration in the nozzle forming region 30A. More specifically, the nozzle rows are formed by arranging the nozzles N at a uniform pitch in a direction inclined by a prescribed angle with respect to the direction of conveyance of the recording medium 12, and furthermore a plurality of the nozzle rows are arranged at uniform pitch in the direction perpendicular to the conveyance direction of the recording medium 12. By adopting this arrangement for the nozzles, it is possible to reduce the effective pitch between the nozzles N as projected to the lengthwise direction of the head (namely, a direction perpendicular to the conveyance direction of the recording medium 12), and therefore a high-density configuration of the nozzles N can be achieved.

In the matrix heads, the effective nozzle row is a row of nozzles projected to the lengthwise direction of the head.

The nozzle protecting regions 30B arranged on either side of the nozzle forming region 30A are regions for protecting the nozzle forming region 30A. The inkjet head 16 according to the present embodiment has the liquid repelling treatment applied only on the nozzle forming region 30A (no liquid repelling treatment is applied on the nozzle protecting regions 30B). In this case, when liquid adheres to the nozzle protecting regions 30B, the liquid wets and spreads on the nozzle protecting regions 30B.

The inkjet head 16 according to the present embodiment ejects droplets of ink from the nozzles N by a so-called piezoelectric jet system. The nozzles N formed in the nozzle surface 30 are respectively connected to pressure chambers P, and droplets of the ink are ejected from the nozzles N by expanding and contracting the volume of the pressure chambers P by causing the side walls of the pressure chambers P to vibrate by means of the piezoelectric elements.

The ink ejection method is not limited to this and may also adopt a composition which performs ejection by employing a thermal method or using an electrostatic actuator.

The image recording unit 10 has the composition described above. In the image recording unit 10, the recording medium 12 is received onto the image recording drum 14 from the previous step through the conveyance drum 26, and is conveyed in rotation while being held by attraction on the circumferential surface of the image recording drum 14. The recording medium 12 passes below the inkjet heads 16C, 16M, 16Y and 16K during this conveyance and ink droplets are ejected and deposited from the inkjet heads 16C, 16M, 16Y and 16K onto the recording surface of the recording medium 12 as the recording medium 12 passes, thereby forming a color image on the recording surface of the recording medium 12. After having completed the image recording, the recording medium 12 is transferred from the image recording drum 14 to the conveyance drum 28 and is conveyed to the subsequent step.

In the image recording unit 10 having the composition described above, the inkjet heads 16C, 16M, 16Y and 16K are installed on a head supporting frame 40 and are arranged around the image recording drum 14 as shown in FIG. 2.

The head supporting frame 40 is constituted of a pair of side plates 42L and 42R, which are arranged perpendicularly to the rotating shaft 18 of the image recording drum 14, and a linking frame 44, which links the pair of side plate 42L and 42R together at the upper end portions thereof.

Each of the side plates 42L and 42R is formed in a plate shape, and the side plates 42L and 42R are disposed so as to face each other across the image recording drum 14. Installation sections 46C, 46M, 46Y and 46K for installing the respective inkjet heads 16C, 16M, 16Y and 16K are provided on the inner side faces of the pair of side plates 42L and 42R (only the installation section 46Y is depicted in FIG. 2 for convenience).

The installation sections 46C, 46M, 46Y and 46K are disposed at a uniform spacing apart radially on a circle concentric with the rotating shaft 18 of the image formation drum 14. The inkjet heads 16C, 16M, 16Y and 16K are installed on the head supporting frame 40 by fixing attachment sections 48C, 48M, 48Y and 48K, which are formed on the respective ends of the heads (only the attachment section 48Y is depicted in FIG. 2 for convenience) onto the installation sections 46C, 46M, 46Y and 46K. By installing the inkjet heads 16C, 16M, 16Y and 16K on the head supporting frame 40, the inkjet heads 16C, 16M, 16Y and 16K are disposed at uniform intervals apart radially on a circle concentric with the rotating shaft 18 of the image formation drum 14.

The head supporting frame 40 for installing the inkjet heads 16C, 16M, 16Y and 16K is arranged slidably in a direction parallel to the rotating shaft 18 of the image formation drum 14 by being guided by guide rails (not illustrated). The head supporting frame 40 is arranged movably between an "image recording position" indicated by the solid lines in FIG. 2 and a "maintenance position" indicated by the dotted lines in FIG. 2, by being driven by a linear drive mechanism (not illustrated) such as, for example, a screw feed mechanism.

When the head supporting frame 40 is disposed in the image recording position, the inkjet heads 16C, 16M, 16Y and 16K are disposed about the periphery of the image recording drum 14 and assume a state capable of image recording.

The maintenance position is set to a position where the inkjet heads 16C, 16M, 16Y and 16K are retracted from the image recording drum 14. A moisturizing unit 50 for moisturizing the inkjet heads 16C, 16M, 16Y and 16K is provided in this maintenance position.

The moisturizing unit 50 includes caps 52C, 52M, 52Y and 52K (only the cap 52Y is depicted in FIG. 2 for convenience) which cover the nozzle surfaces of the inkjet heads 16C, 16M, 16Y and 16K. When the inkjet heads 16C, 16M, 16Y and 16K are not used for a long time, or the like, the nozzle surfaces are covered with the caps 52C, 52M, 52Y and 52K. Thereby, ejection failure due to drying is prevented.

A pressurizing and suctioning mechanism (not illustrated) is provided for the caps 52C, 52M, 52Y and 52K, in such a manner that the interior of the nozzles can be pressurized and suctioned.

Moreover, a cleaning liquid supply mechanism (not illustrated) is provided for the caps 52C, 52M, 52Y and 52K, in such a manner that cleaning liquid can be supplied to the interior of the caps.

A waste liquid tray 54 is disposed in a position below the caps 52C, 52M, 52Y and 52K. The cleaning liquid supplied to the caps 52C, 52M, 52Y and 52K is discarded into the waste liquid tray 54 and is recovered into a waste liquid tank 58 through a waste liquid recovery pipe 56.

A nozzle surface cleaning apparatus 60 for cleaning the nozzle surfaces 30C, 30M, 30Y and 30K of the inkjet heads 16C, 16M, 16Y and 16K is arranged between the image recording position and the maintenance position. The nozzle surfaces 30C, 30M, 30Y and 30K of the inkjet heads 16C, 16M, 16Y and 16K are cleaned by the nozzle surface cleaning apparatus 60 while the inkjet heads are moved from the maintenance position to the image recording position or from the image recording position to the maintenance position.

Below, the composition of the nozzle surface cleaning apparatus 60 is described.

Composition of Nozzle Surface Cleaning Apparatus

As shown in FIG. 2, the nozzle surface cleaning apparatus 60 includes a cleaning liquid deposition device (cleaning liquid ejection unit) 62 and a nozzle surface wiping device 64.

The cleaning liquid deposition device 62 deposits the cleaning liquid onto the nozzle surfaces 30C, 30M, 30Y and 30K of the inkjet heads 16C, 16M, 16Y and 16K which are moved from the maintenance position toward the image recording position.

The nozzle surface wiping device 64 wipes the nozzle surface 30C, 30M, 30Y and 30K of the inkjet heads 16C, 16M, 16Y and 16K on which the cleaning liquid has been deposited, by pressing wiping webs against the nozzle surfaces 30C, 30M, 30Y and 30K.

The cleaning liquid deposition device 62 and the nozzle surface wiping device 64 are disposed in the movement path of the head supporting frame 40. In this case, the cleaning liquid deposition device 62 is disposed to the maintenance position side of the nozzle surface wiping device 64. By this means, the nozzle surfaces 30C, 30M, 30Y and 30K of the inkjet heads 16C, 16M, 16Y and 16K can be wiped by the wiping webs after deposition of the cleaning liquid, while the inkjet heads are moved from the maintenance position to the image recording position.

Composition of Cleaning Liquid Deposition Device

Figure 4:
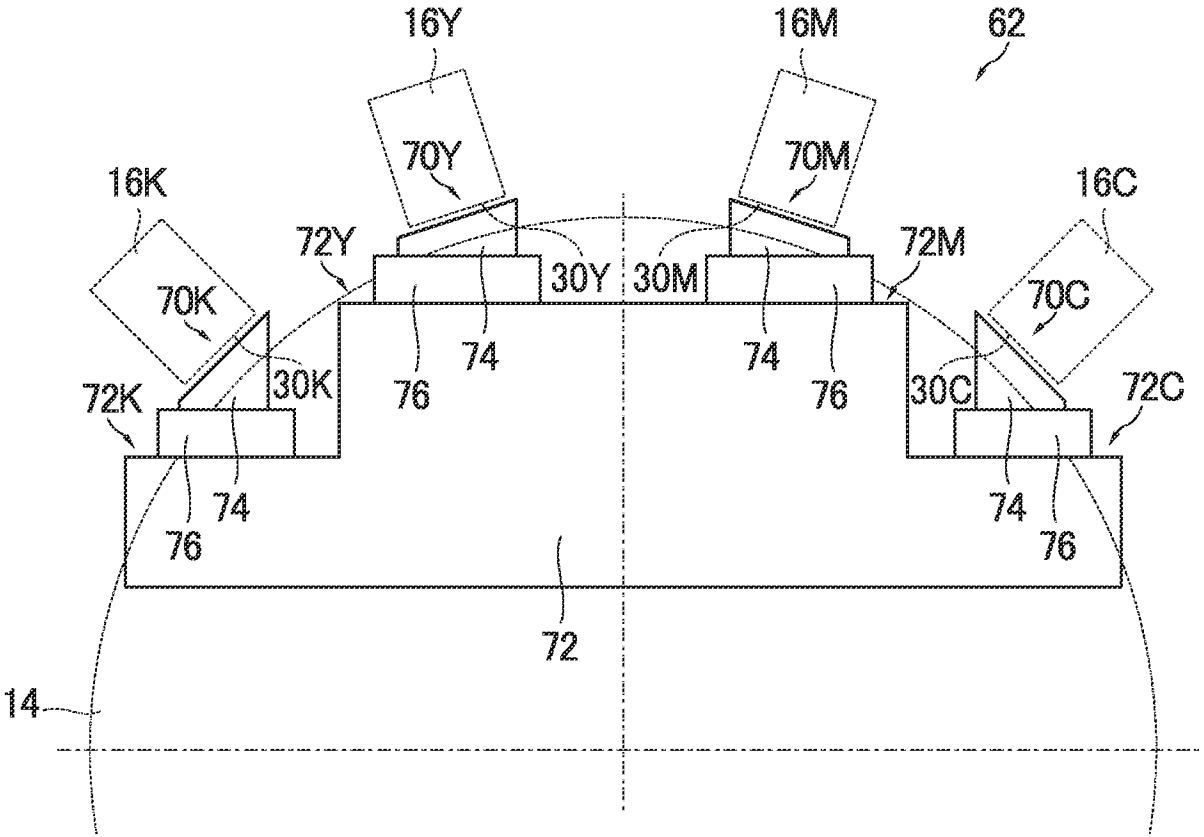
FIG. 4 is a side view diagram showing a cleaning liquid deposition device viewed from the maintenance position side.

FIG. 4 is a side view diagram showing the cleaning liquid deposition device 62 viewed from the maintenance position side.

The cleaning liquid deposition device 62 is constituted of cleaning liquid deposition units 70C, 70M, 70Y and 70K which are arranged correspondingly to the inkjet heads 16C, 16M, 16Y and 16K, and a base 72, on which the cleaning liquid deposition units 70C, 70M, 70Y and 70K are mounted. The cleaning liquid deposition device 62 is disposed to the inner side of the waste liquid tray 54, which is arranged in the moisturizing unit 50 (see FIG. 2).

<Composition of Base>

The base 72 is horizontally arranged so as to be raisable and lowerable by an elevator device (not shown). Cleaning liquid deposition unit attachment sections 72C, 72M, 72Y and 72K are formed in the upper surface portion of the base 72. The cleaning liquid deposition units 70C, 70M, 70Y and 70K are fixed to the cleaning liquid deposition unit attachment sections 72C, 72M, 72Y and 72K formed on the base 72, by bolts, or the like, and are thereby installed in prescribed positions. By installing the cleaning liquid deposition units 70C, 70M, 70Y and 70K on the base 72, the cleaning liquid deposition units 70C, 70M, 70Y and 70K are arranged over the movement path of the corresponding inkjet heads 16C, 16M, 16Y and 16K (namely, over the movement path from the maintenance position to the image recording position).

<Composition of Cleaning Liquid Deposition Unit>

Next, the composition of the cleaning liquid deposition units 70C, 70M, 70Y and 70K is described.

The cleaning liquid deposition units 70C, 70M, 70Y and 70K each have the same basic composition and therefore the composition of a cleaning liquid deposition unit 70 is described here.

Figure 5:
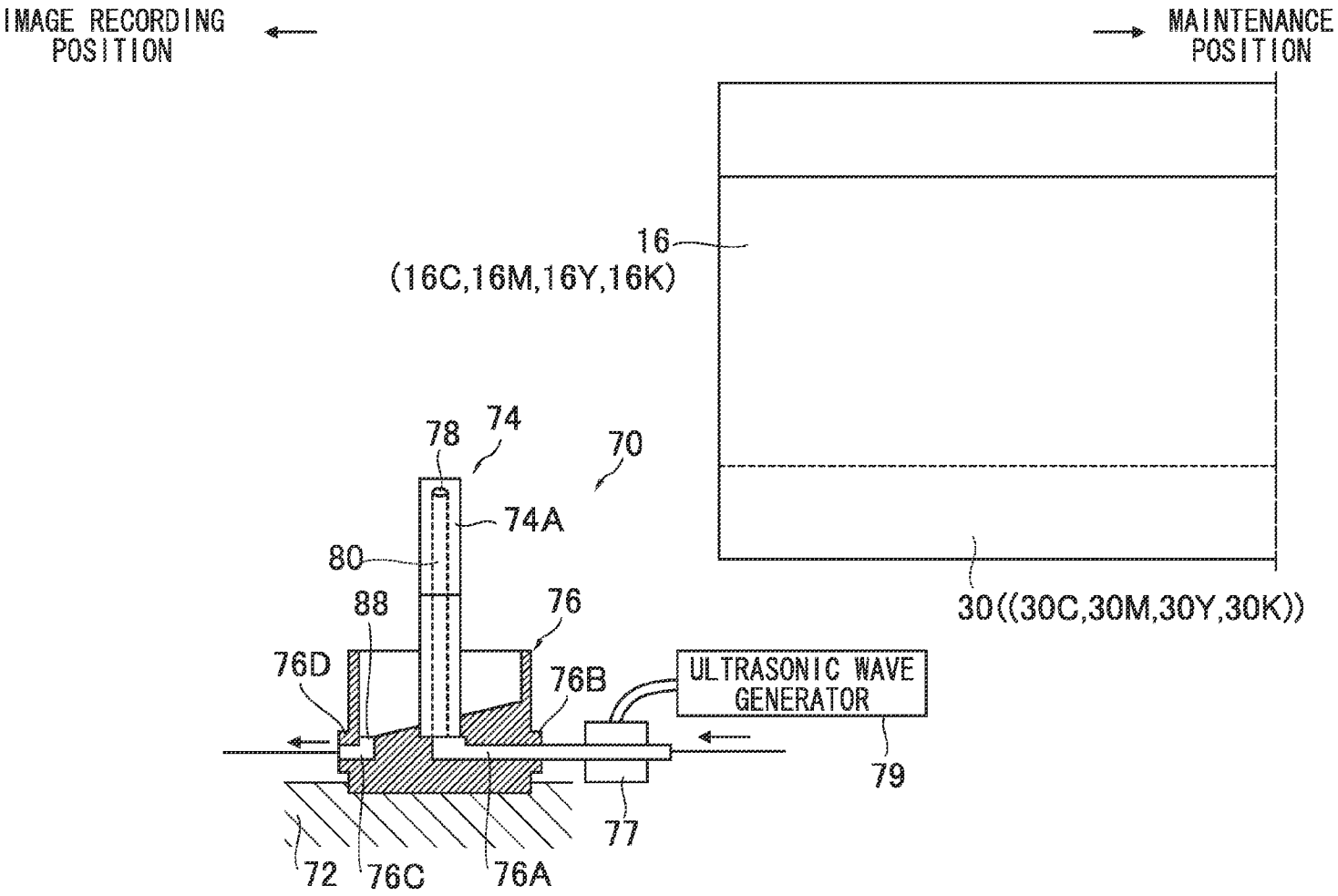
FIG. 5 is a front view diagram of a cleaning liquid deposition unit.
Figure 6:
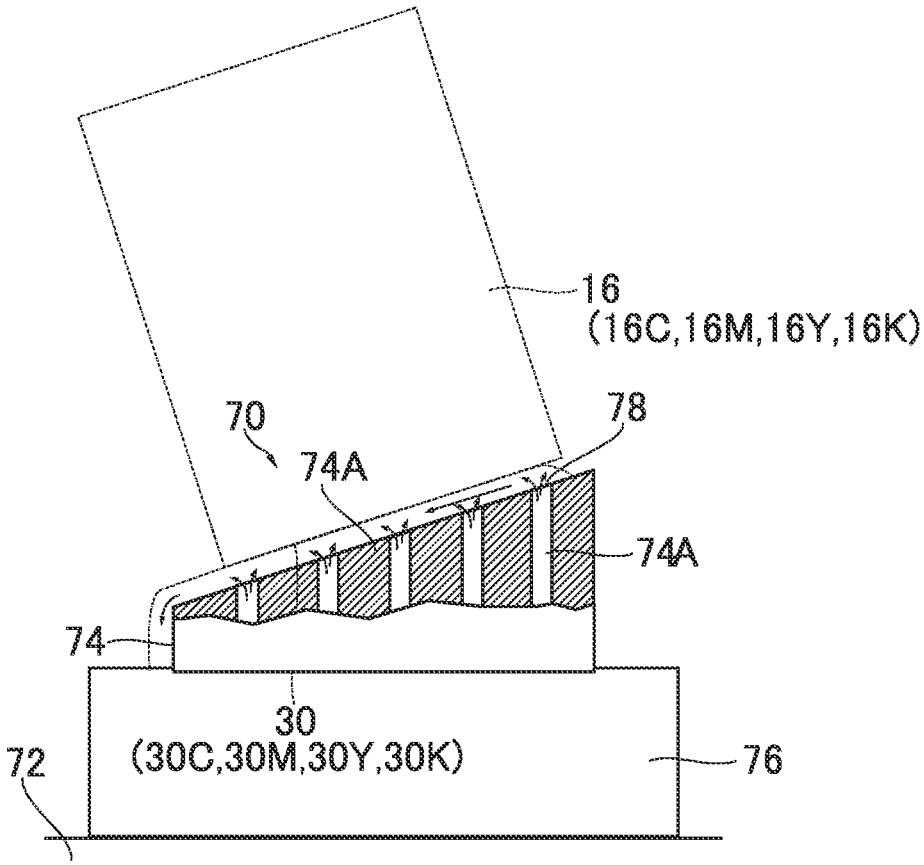
FIG. 6 is a side view diagram of the cleaning liquid deposition unit.

FIGS. 5 and 6 are a front view diagram and a side view diagram, respectively, of the cleaning liquid deposition unit 70.

As shown in FIGS. 5 and 6, the cleaning liquid deposition unit 70 includes: a cleaning liquid deposition head 74, which deposits the cleaning liquid onto the nozzle surface 30, and a cleaning liquid recovery tray 76, which recovers the cleaning liquid falling down from the nozzle surface 30. The cleaning liquid recovery tray 76 is formed in the shape of a rectangular box of which the upper portion is open.

The cleaning liquid deposition head 74 is formed in a rectangular block shape with an inclined upper surface, and has an inclined cleaning liquid holding surface 74A on the upper portion thereof. The cleaning liquid holding surface 74A is formed at the same angle of inclination of the nozzle surface 30 of the head that is to be cleaned, and is formed to a slightly greater width than the width of the nozzle surface 30 (the width in the recording medium conveyance direction).

A cleaning liquid emission port 78 is formed in the vicinity of the upper part of the cleaning liquid holding surface 74A, and the cleaning liquid is ejected from the cleaning liquid emission port 78. The ejected cleaning liquid strikes the nozzles on the nozzle surface 30 and is able to remove foreign matter adhering to the nozzle surface. Moreover, the cleaning liquid which has flowed out from the cleaning liquid emission port 78 flows down the inclined cleaning liquid holding surface 74A. By this means, a layer (film) of the cleaning liquid is formed on the cleaning liquid holding surface 74A. The cleaning liquid is deposited onto the nozzle surface 30 of the inkjet head 16 by bringing the nozzle surface 30 into contact with the layer of the cleaning liquid formed on the cleaning liquid holding surface 74A.

A cleaning liquid supply flow channel 80 connected to the cleaning liquid emission port 78 is formed inside the cleaning liquid deposition head 74. The cleaning liquid supply flow channel 80 is connected to a connection flow channel 76A formed in the cleaning liquid recovery tray 76, and the connection flow channel 76A is connected to a cleaning liquid supply port 76B formed in the cleaning liquid recovery tray 76. When the cleaning liquid is supplied to the cleaning liquid supply port 76B in the cleaning liquid deposition head 74, the cleaning liquid flows out from the cleaning liquid emission port 78.

The cleaning liquid is supplied from a cleaning liquid tank (not illustrated). A pipe (not illustrated) connected to the cleaning liquid tank is connected to the cleaning liquid supply port 76B. A cleaning liquid supply pump (not illustrated) and a valve (not illustrated) are arranged in this pipe, and by opening the valve and driving the cleaning liquid supply pump, the cleaning liquid is supplied from the cleaning liquid tank to the cleaning liquid deposition head 74.

An ultrasonic oscillating element 77 is disposed in the periphery of the cleaning liquid supply port 76B, and an ultrasonic wave generator 79 is connected to the ultrasonic oscillating element 77. The ultrasonic wave generator 79 generates an ultrasonic wave when being supplied with electric power, and the ultrasonic wave generator 77 has a function of converting the ultrasonic wave to a mechanical vibration. Desirably, the ultrasonic wave having a high frequency of 700 kHz or above (for example, approximately 1 MHz) is applied by the ultrasonic oscillating element 77. By cleaning with the ultrasonic wave of 700 kHz or above (so-called "mega-sonic cleaning"), it is possible to reduce damage to the nozzles caused by the ultrasonic wave.

The cleaning liquid recovery tray 76 is formed in the shape of the rectangular box, the upper portion of which is open, as described above. The bottom face of the interior of the cleaning liquid recovery tray 76 is formed at an inclination, and a cleaning liquid outlet 88 is formed in the lower end portion of the bottom face in the direction of inclination. The cleaning liquid outlet 88 is connected to a cleaning liquid recovery port 76D formed in the side face portion of the cleaning liquid recovery tray 76 through a cleaning liquid recovery flow channel 76C formed inside the cleaning liquid recovery tray 76.

The cleaning liquid emitted from the cleaning liquid emission port 78 of the cleaning liquid deposition head 74 falls down the cleaning liquid holding surface 74A and is recovered into the cleaning liquid recovery tray 76. The cleaning liquid recovered by the cleaning liquid recovery tray 76 is sent to the nozzle surface wiping device 64 and is used for flushing waste liquid, which is described later in detail.

The cleaning liquid deposition units 70 (70C, 70M, 70Y, 70K) are each composed as described above. The cleaning liquid deposition device 62 is composed by installing the cleaning liquid deposition units 70C, 70M, 70Y and 70K on the cleaning liquid deposition unit installation sections 72C, 72M, 72Y and 72K formed on the base 72.

The operation of the cleaning liquid deposition device 62 is controlled by a controller, which is not illustrated. The controller controls the cleaning liquid deposition operation by the cleaning liquid deposition device 62 by controlling the driving of the elevator apparatus, and the like.

Cleaning liquid having a main component of diethylene glycol monobutyl ether, for example, is used as the cleaning liquid. By depositing the cleaning liquid of this type to the nozzle surface 30, it is possible to readily dissolve and remove solid attached matter originating from the ink which has adhered to the nozzle surface 30.

The spraying of the cleaning liquid can be performed using a pump, or using a water head pressure. It is desirable that there are no pulsations, in order to uniformly apply the cleaning liquid.

The cleaning liquid deposition device 62 which is shown in FIGS. 4 to 6 is composed in such a manner that the nozzle surface 30 and the cleaning liquid holding surface 74A are substantially parallel, and the cleaning liquid ejection port 78 is composed so as to be positioned in the perpendicular direction to the installation plane, but the present invention is not limited to this. When the nozzles formed in the nozzle surface 30 have a tapered shape of a prescribed tapering angle, then the angle at which the cleaning liquid is sprayed can be adjusted in accordance with the tapering angle of the nozzles. By spraying the cleaning liquid in accordance with the tapering angle of the nozzles, it is possible to remove foreign matter up to and including the interior of the nozzles.

The control of the spraying angle of the cleaning liquid can be performed by controlling the gradient of the cleaning liquid deposition device 62 or using a cleaning liquid deposition device 62 that is matched to the tapering angle of the nozzles.

<Action of Cleaning Liquid Deposition Device>

Next, a cleaning liquid deposition operation by the cleaning liquid deposition device 62 according to the present embodiment having the composition described above is explained.

The cleaning liquid deposition device 62 deposits the cleaning liquid onto the nozzle surfaces 30 (30C, 30M, 30Y, 30K) of the inkjet heads 16 (16C, 16M, 16Y, 16K) while the inkjet heads 16 (16C, 16M, 16Y, 16K) move from the maintenance position to the image recording position. More specifically, the cleaning liquid is deposited as follows.

The whole of the cleaning liquid deposition device 62 is arranged raisable and lowerable. When not performing cleaning, the cleaning liquid deposition device 62 is disposed in a prescribed standby position. During cleaning, the cleaning liquid deposition device 62 is raised by a prescribed amount from the standby position to a prescribed operating position.

When the cleaning liquid deposition device 62 is moved to the operating position, the cleaning liquid deposition units 70C, 70M, 70Y and 70K are set in prescribed cleaning liquid deposition positions. Thereby, it is possible to deposit the cleaning liquid onto the nozzle surfaces 30C, 30M, 30Y and 30K of the inkjet heads 16C, 16M, 16Y and 16K, by means of the cleaning liquid deposition heads 74 arranged in the cleaning liquid deposition units 70C, 70M, 70Y and 70K. When the cleaning liquid deposition units 70C, 70M, 70Y and 70K are set in the prescribed cleaning liquid deposition positions, the controller drives the linear drive mechanism and causes the head supporting frame 40 to move at a prescribed speed of movement from the maintenance position to the image recording position.

On the other hand, the controller also drives the cleaning liquid supply pump in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid is ejected at a prescribed flow rate from the cleaning liquid emission ports 78 of the cleaning liquid deposition heads 74 arranged in the respective cleaning liquid deposition units 70C, 70M, 70Y and 70K. The cleaning liquid which has ejected from the cleaning liquid emission ports 78 removes foreign matters in the nozzle surface and flows down over the cleaning liquid holding surfaces 74A. Thus, a layer (film) of the cleaning liquid is formed on the cleaning liquid holding surfaces 74A.

The nozzle surfaces 30C, 30M, 30Y and 30K of the inkjet heads 16C, 16M, 16Y and 16K moving toward the image recording position make contact with the layer of cleaning liquid formed on the cleaning liquid holding surfaces 74A of the cleaning liquid deposition heads 74, and thereby the cleaning liquid is deposited onto the nozzle surfaces 30C, 30M, 30Y and 30K.

Composition of Nozzle Surface Wiping Device

Figure 7:
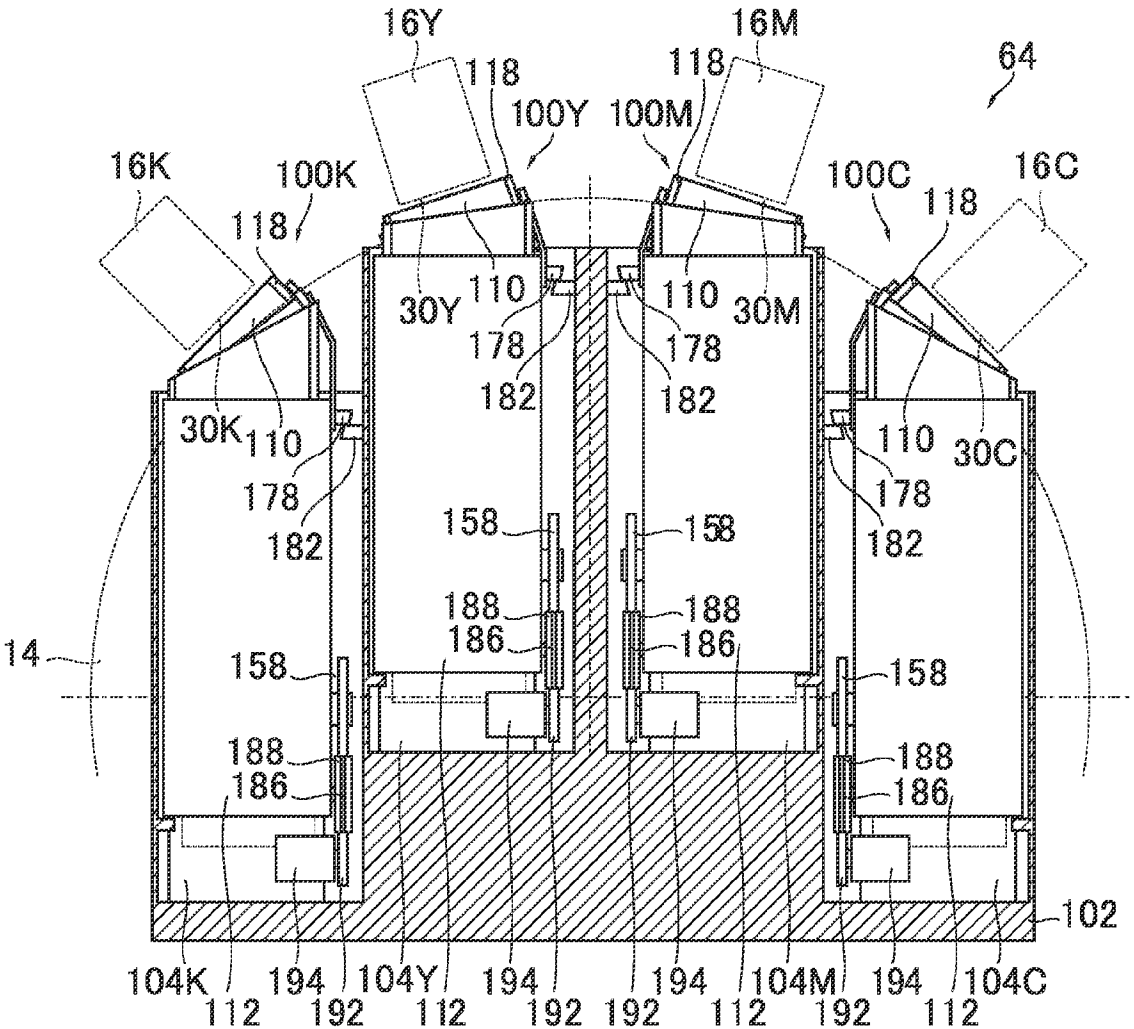
FIG. 7 is a side view diagram showing a wiping device viewed from the maintenance position side.

FIG. 7 is a side view diagram showing the nozzle surface wiping device 64 viewed from the maintenance position side.

Figure 8:
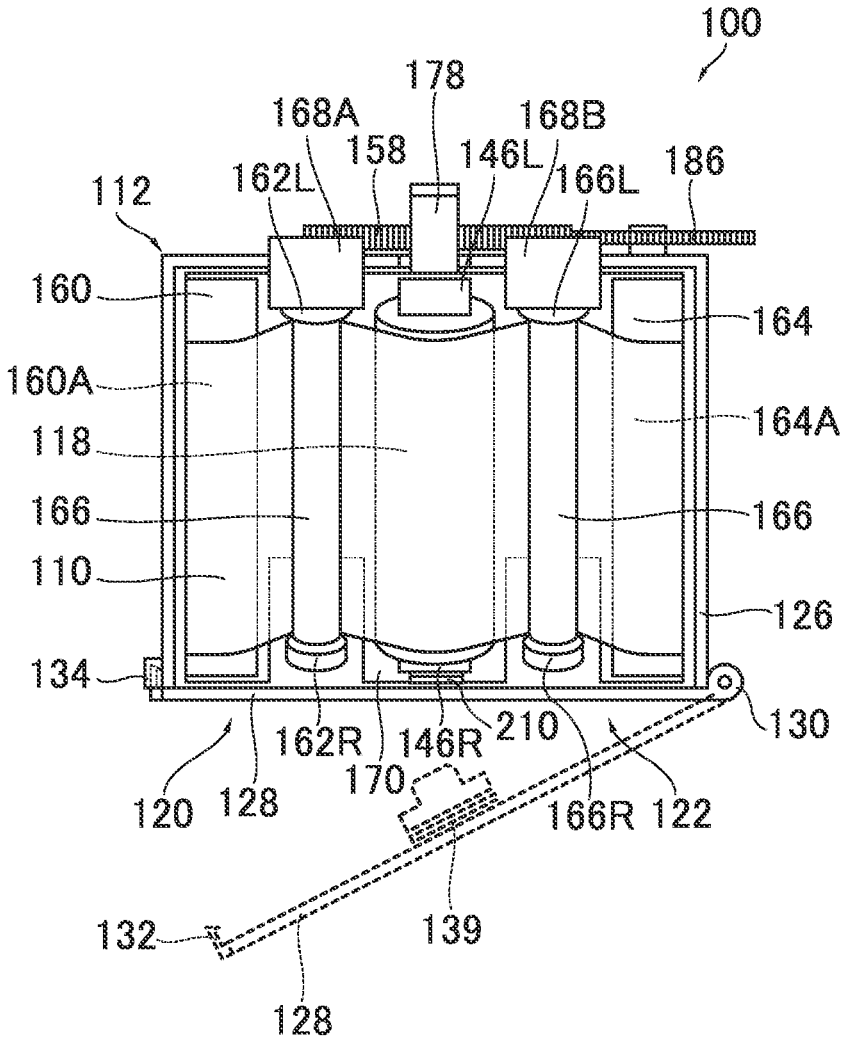
FIG. 8 is a plan diagram of a wiping unit.

As shown in FIG. 8, the nozzle surface wiping device 64 includes: wiping units 100C, 100M, 100Y and 100K, which are arranged correspondingly to the inkjet heads 16C, 16M, 16Y and 16K; and a wiping device main frame 102, in which the wiping units 100C, 100M, 100Y and 100K are set.

<Composition of Wiping Device Main Frame>

The wiping device main frame 102 is horizontally arranged so as to be raisable and lowerable by an elevator device (not shown). The wiping device main frame 102 is formed in a box shape having an open upper end portion, and wiping unit installation sections 104C, 104M, 104Y and 104K for installing the wiping units 100C, 100M, 100Y and 100K are arranged inside wiping device main frame 102.

The wiping unit installation sections 104C, 104M, 104Y and 104K are respectively formed as spaces which can accommodate the wiping units 100C, 100M, 100Y and 100K, and the upper portions thereof are open. The wiping units 100C, 100M, 100Y and 100K are set in the respective wiping unit installation sections 104C, 104M, 104Y and 104K by being inserted vertically downward through the upper openings of the wiping unit installation sections 104C, 104M, 104Y and 104K.

A lock mechanism (not shown) is arranged on each of the wiping unit installation sections 104C, 104M, 104Y and 104K, in such a manner that the installed wiping units 100C, 100M, 100Y and 100K can be locked. The lock mechanisms are, for example, composed so as to automatically operate when the wiping units 100C, 100M, 100Y and 100K are inserted into the wiping unit installation sections 104C, 104M, 104Y and 104K.

<Composition of Wiping Unit>

Next, the composition of the wiping units 100C, 100M, 100Y and 100K is described.

The wiping units 100C, 100M, 100Y and 100K all have the same basic composition and therefore the composition is described here with respect to one wiping unit 100. The same applies to the wiping unit installation sections 104C, 104M, 104Y and 104K, and here one wiping unit installation section 104 is described.

Figure 9:
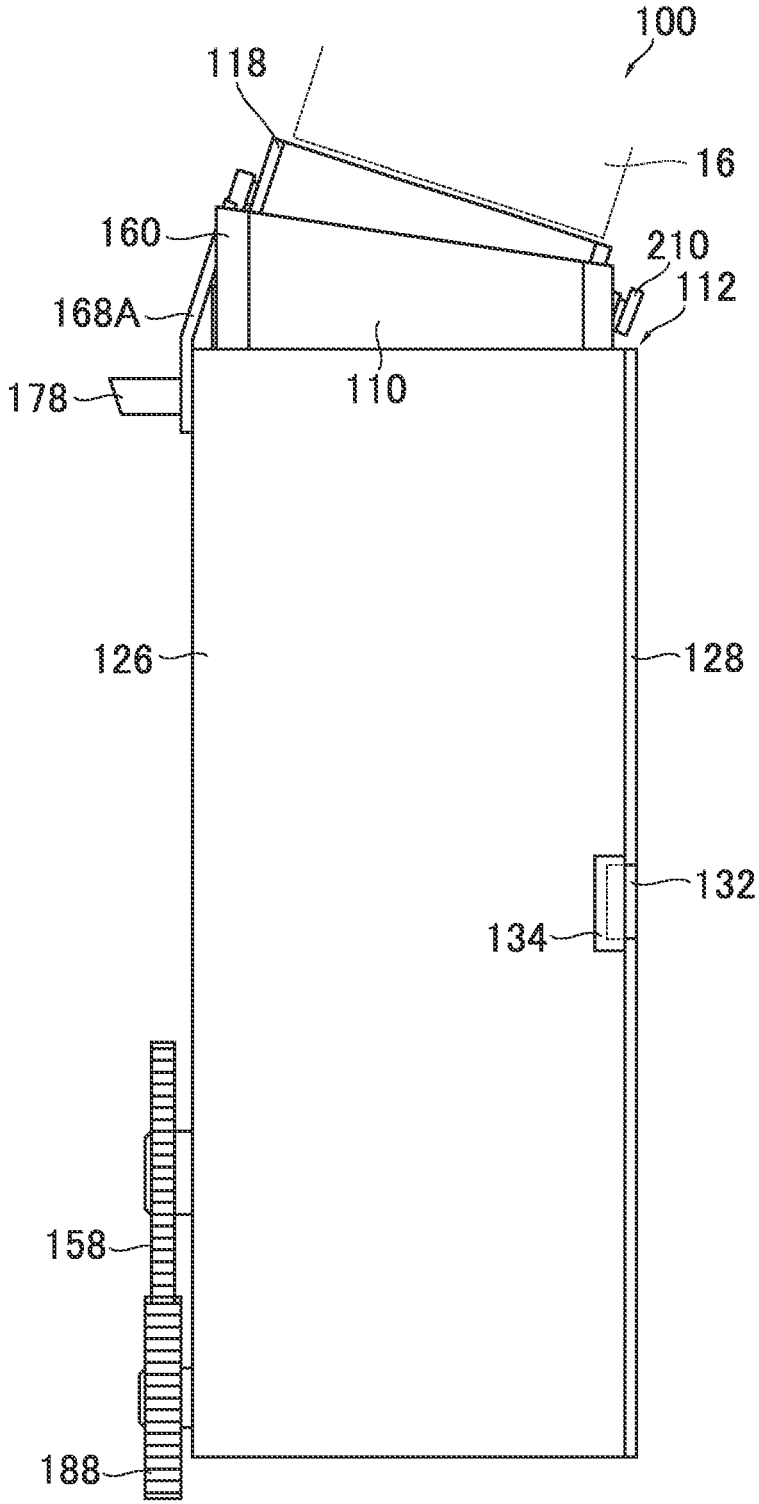
FIG. 9 is a side view diagram showing the wiping unit viewed from the image recording position side.
Figure 10:
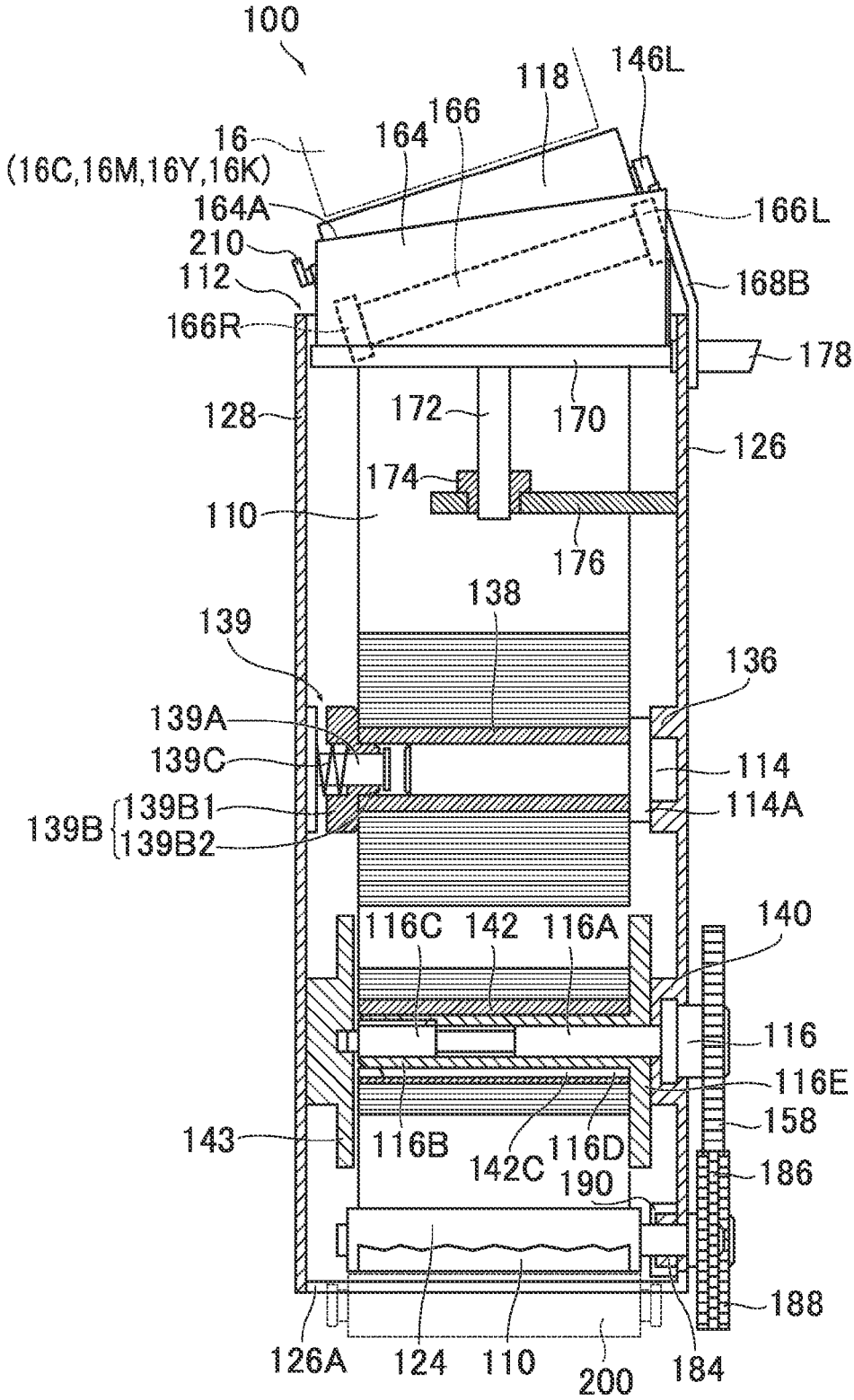
FIG. 10 is a partial cross-sectional side view diagram of the wiping unit.
Figure 11:
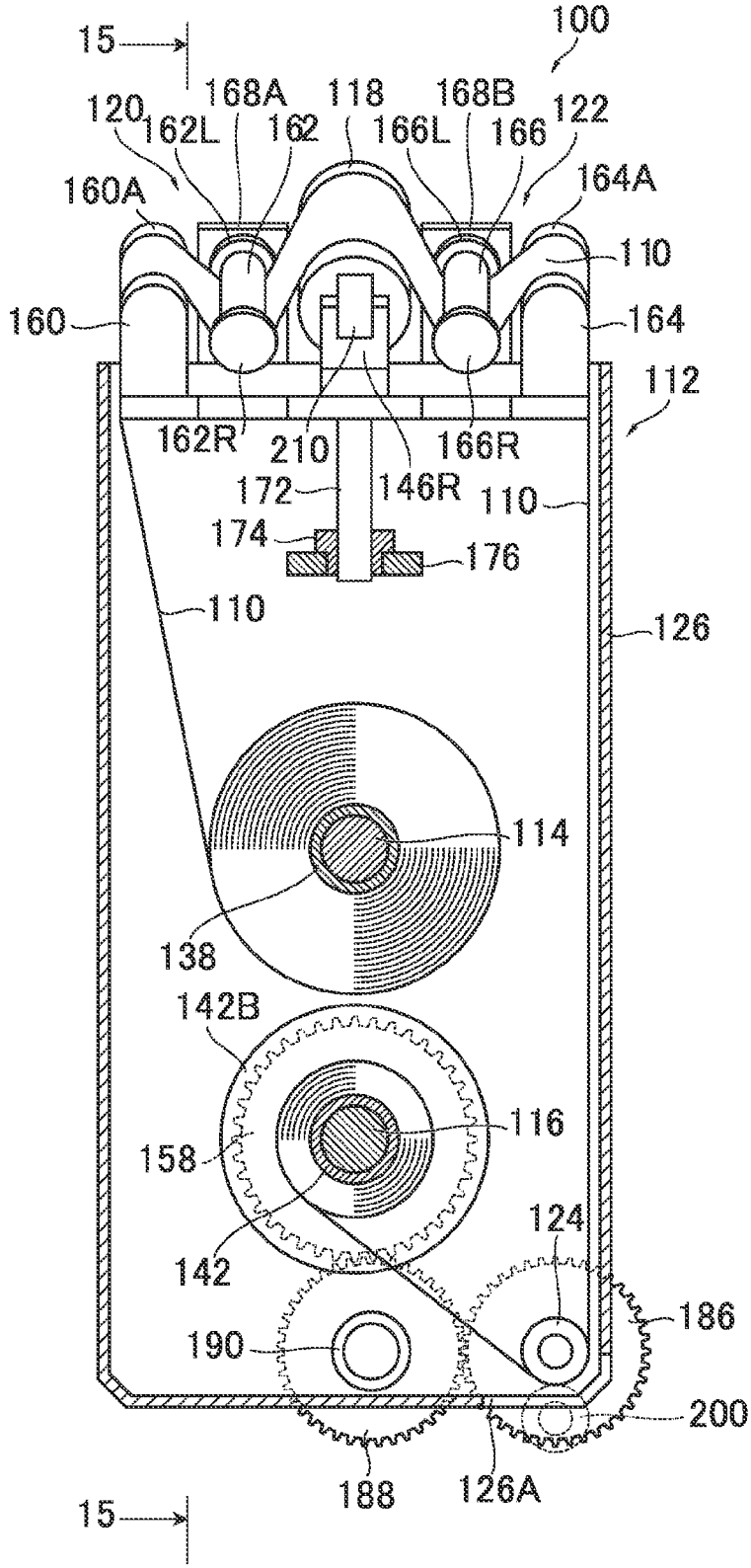
FIG. 11 is a partial cross-sectional front view diagram of the wiping unit.
Figure 12:
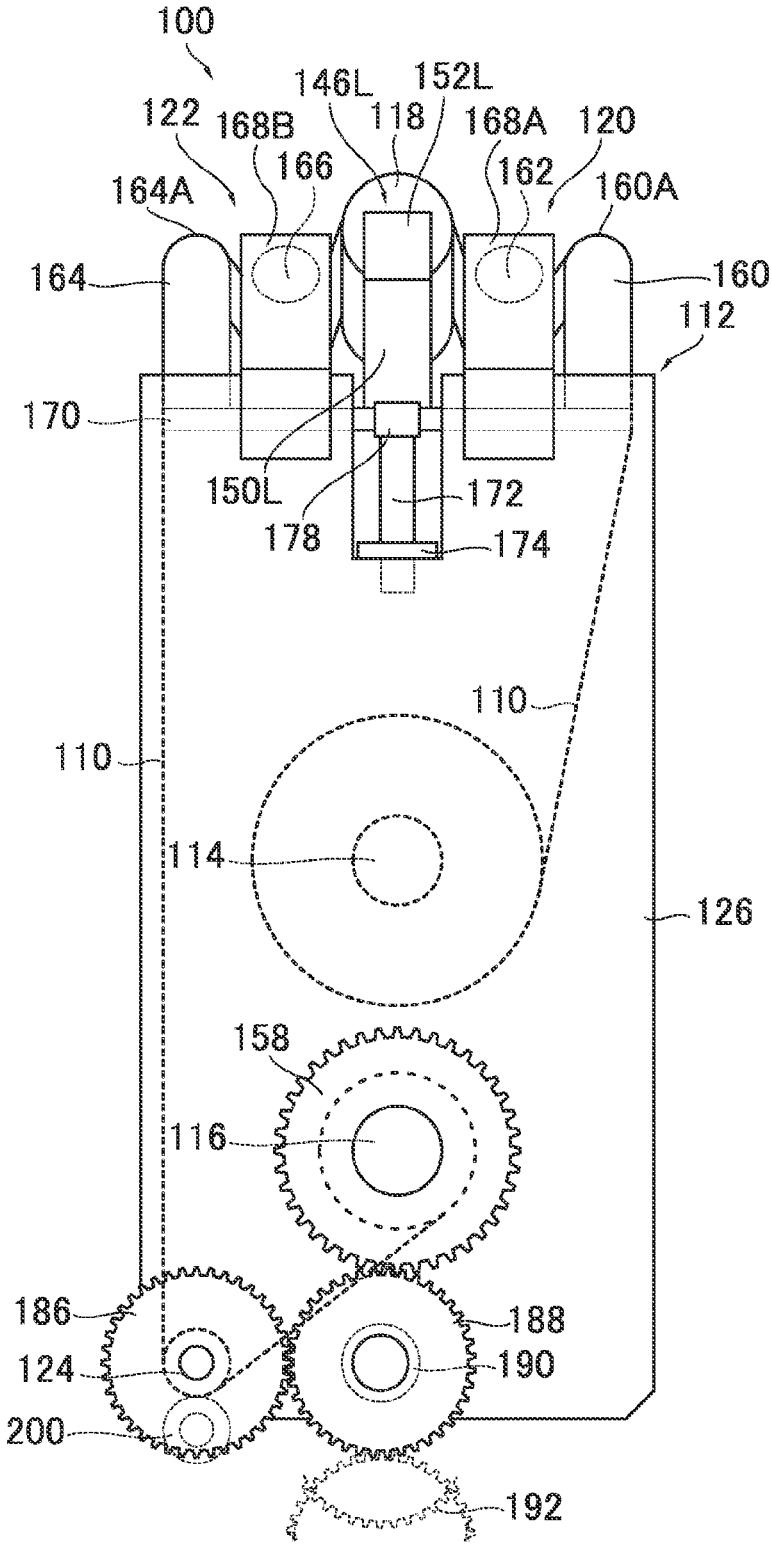
FIG. 12 is a rear view diagram of the wiping unit.

FIG. 8 is a plan diagram of the wiping unit 100, FIG. 9 is a side view diagram of the wiping unit 100 viewed from the image recording position side, FIG. 10 is an partial cross-sectional side view of the wiping unit 100, FIG. 11 is a partial cross-sectional front view of the wiping unit 100, and FIG. 12 is a rear view of the wiping unit 100.

As shown in FIGS. 8 to 12, the wiping unit 100 has a wiping web 110 formed in a band shape, which is wrapped about a pressing roller 118 obliquely disposed, and the wiping unit 100 wipes and cleans the nozzle surface of the inkjet head by pressing the wiping web 110 wrapped about the pressing roller 118, against the nozzle surface of the inkjet head.

The wiping unit 100 includes: a case 112; a pay-out spindle 114, which pays out the wiping web 110 formed in a band shape; a take-up spindle 116, which takes up the wiping web 110; a front-stage guide 120, which guides the wiping web 110 paid out from the pay-out spindle 114 so as to be wrapped about the pressing roller 118; a rear-stage guide 122, which guides the wiping web 110 having been wrapped about the pressing roller 118 so as to be taken up onto the take-up spindle 116; and a grid roller (drive roller) 124, which conveys the wiping web 110.

The case 112 is constituted of a case main body 126 and a lid 128. The case main body 126 is formed in a box shape, which is long in the vertical direction, and the upper end portion and the front face portion thereof are open. The lid 128 is attached to the front face portion of the case main body 126 with a hinge 130. The front face portion of the case main body 126 is opened and closed by means of the lid 128.

The lid 128 is provided with an elastically deformable locking hook 132, and the lid 128 is fixed to the case main body 126 by means of the locking hook 132, which elastically deforms and engages with a hook receiving section 134 formed on the case main body 126.

The pay-out spindle 114 has a cylindrical shape, and the base end portion thereof is fixed (supported in cantilever fashion) on a spindle bearing section 136 arranged on the case main body 126, with the pay-out spindle 114 installed horizontally inside the case main body 126. A pay-out core 138 is detachably installed on the pay-out spindle 114. The pay-out spindle 114 is formed to be slightly shorter than the length of the pay-out core 138. Therefore, when the pay-out core 138 is installed, the pay-out spindle 114 recedes in the inner circumference portion of the pay-out core 138.

The pay-out core 138 has a cylindrical shape. The wiping web 110 formed in a band shape is wound in the form of a roll about the pay-out core 138.

The pay-out core 138 is installed on the pay-out spindle 114 by inserting the pay-out spindle 114 into the inner circumferential portion of the pay-out core 138 and thereby fitting the pay-out core 138 onto the pay-out spindle 114. The pay-out core 138 that has been installed on the pay-out spindle 114 rotates about the pay-out spindle 114 and is rotatably supported.

Here, as shown in FIG. 10, a pay-out core pressing block 139 is arranged in the lid 128 of the case 112 so as to correspond to the installation position of the pay-out spindle 114. When the lid 128 is closed, the pay-out core pressing block 139 presses the end face of the pay-out core 138 installed on the pay-out spindle 114, in the axial direction thereof, thereby applying friction to the pay-out core 138.

The pay-out core pressing block 139 includes: an axle section 139A, a pressing section 139B, which is slidably arranged on the axle section 139A; and a spring 139C, which impels the pressing section 139B in the axial direction.

The axle section 139A has a round bar shape, and is installed perpendicularly on the inner surface of the lid 128. The axle section 139A is arranged so as to be positioned coaxially with the pay-out spindle 114, when the lid 128 is closed.

The pressing section 139B includes a boss 139B1 and a flange section 139B2. The boss 139B1 has a cylindrical shape, and the outer circumference thereof is formed to have substantially the same diameter as the inner diameter of the pay-out core 138 and so as to be insertable in the inner circumference portion of the pay-out core 138. Furthermore, the inner diameter of the boss 139B1 is formed to have substantially the same diameter as the outer diameter of the axle section 139A, and is slidable along the axle section 139A. The flange section 139B2 is formed integrally with the base end portion of the boss 139B1 and is formed so as to extend in the outer radial direction. The base end portion of the flange section 139B2 is formed with an enlarged inner diameter, and the spring 139C is accommodated in the inner circumference portion of this enlarged flange 139B2. The pressing section 139B is impelled toward the front end direction of the axle section 139A by this spring 139C.

A flange section is formed in the front end of the axle section 139A and detachment of the pressing section 139B is prevented by this flange section.

In the pay-out core pressing block 139, which is composed in this way, when the lid 128 of the case 112 is closed, the boss 139B1 of the pressing section 139B fits into the inner circumference portion of the pay-out core 138, and furthermore the flange section 139B2 abuts against the end face of the pay-out core 138 and presses the pay-out core 138 in the axial direction by the force of the spring 139C. Thereby, the pay-out core 138 is disposed and pressed between the pay-out core pressing block 139 and the flange 114A, and friction is applied when the core 138 rotates.

The wiping web 110 uses, for example, a knitted or woven sheet made of ultra-fine fibers of PET (polyethylene terephthalate), PE (polyethylene), NY (nylon), acryl, or the like, and is formed in a flexible band shape having a width corresponding to the width of the nozzle surface of the head being wiped.

The take-up spindle 116 is disposed so that the axis thereof is horizontal, at a position below the pay-out spindle 114. More specifically, the take-up spindle 116 is arranged below and parallel with the pay-out spindle 114.

As shown in FIG. 10, the take-up spindle 116 includes: a main shaft 116A; a slipping shaft 116B, which is arranged rotatably in a circumferential direction about the main shaft 116A; and a torque limiter 116C, which couples the main shaft 116A and the slipping shaft 116B, and is composed in such a manner that the slipping shaft 116B slides with respect to the main shaft 116A if a load (torque) over a threshold is applied.

The main shaft 116A has a round rod shape, and the vicinity of the base end portion thereof is rotatably supported on a bearing section 140, which is arranged in the case main body 126.

The slipping shaft 116B has a cylindrical shape, and is arranged rotatably in the circumferential direction about the outer circumference portion of the main shaft 116A.

The torque limiter 116C is arranged in the inner circumference portion of the front end of the slipping shaft 116B, and couples together the main shaft 116A and the slipping shaft 116B. The torque limiter 116C includes an input side rotating body (not illustrated) and an output side rotating body (not illustrated) arranged coaxially with the input side rotating body, and when a load (torque) over the threshold is applied to the output side rotating body with respect to the input side rotating body, the torque limiter 116C slides between the input side rotating body and the output side rotating body. The input side rotating body of the torque limiter 116C is connected to the main shaft 116A (for example, through a key and key groove, or a boss and boss hole, or by fixing in an integrated fashion so as to transmit rotation), and the output side rotating body is connected to the slipping shaft 116B (for example, through a key and key groove, or a boss and boss hole, or by fixing in an integrated fashion so as to transmit rotation), whereby the main shaft 116A and the slipping shaft 116B are coupled so as to enable transmission of rotation therebetween. Thus, a function is achieved whereby the slipping shaft 116B slides with respect to the main shaft 116A, when a torque over the threshold is applied to the slipping shaft 116B.

In the take-up spindle 116 having the composition described above, if a load (torque) applied to the slipping shaft 116B is within a prescribed range, then no slipping occurs and the slipping shaft 116B rotates in unison with the main spindle 116A. On the other hand, if a load (torque) applied to the slipping shaft 116B exceeds the prescribed range, then slipping occurs between the slipping shaft 116B and the main shaft 116A, and it is possible to prevent an undue load being applied to the main shaft 116A.

A take-up core 142 which takes up the wiping web 110 paid out by the pay-out core 138 is installed on the take-up spindle 116.

The composition of the take-up core 142 is substantially the same as the composition of the pay-out core 138. More specifically, the take-up core 142 has a cylindrical shape. The leading end of the wiping web 110 wound up on the pay-out core 138 is fixed to the take-up core 142.

The take-up core 142 is installed on the take-up spindle 116 by fitting the take-up spindle 116 into the inner circumference portion of the take-up core 142.

Here, as shown in FIG. 10, the take-up core 142 has a key groove 142C formed in the inner circumference portion thereof. On the other hand, a key 116D which engages with the key groove 142C is formed in the outer circumference of the take-up spindle 116 (the outer circumference of the slipping shaft 116B). When installing the take-up core 142, the key 116D formed on the take-up spindle 116 is fitted into the key groove 142C formed in the take-up core 142. Thereby, the take-up core 142 is installed in such a manner that the rotation of the take-up spindle 116 can be transmitted to the take-up core 142.

Furthermore, as shown in FIG. 10, a guide plate 143 is arranged on the inner side of the lid 128 of the case 112 so as to correspond to the installation position of the take-up spindle 116. The guide plate 143 has a circular disk shape of a diameter corresponding to the take-up diameter of the wiping web 110, and is arranged at the front end of the take-up spindle 116 when the lid 128 is closed.

Furthermore, as shown in FIG. 10, a flange 116E of substantially the same diameter as the guide plate 143 is formed on the base end portion of the take-up spindle 116. The take-up core 142 is installed on the take-up spindle 116 and is disposed between the flange 116E and the guide plate 143 when the lid 128 of the case 112 is closed. The wiping web 110 taken up onto the take-up core 142 is wound about the take-up core 142 while both edges of the wiping web 110 are guided by the flange 116E and the guide plate 143.

The main shaft 116A of the take-up spindle 116 is arranged in such a manner that the base end portion thereof projects the outer side of the case main body 126, and a take-up spindle drive gear 158 is fixed to this projecting base end portion. The take-up spindle 116 (main shaft 116A) is rotated by driving and rotating the take-up spindle drive gear 158.

The pressing roller 118 is disposed above the pay-out spindle 114 (in the present embodiment, the pressing roller 118, the pay-out spindle 114 and the take-up spindle 116 are disposed on the same straight line), and is arranged at a prescribed angular inclination with respect to the horizontal plane. In other words, the pressing roller 118 is disposed in accordance with the angular inclination of the nozzle surface 30 of the inkjet head 16 that is to be wiped (i.e., the axis of the pressing roller 118 is parallel with the nozzle surface) in order to press the wiping web 110 against the nozzle surface 30 of the inkjet head 16.

In a case where the central portion of the nozzle surface 30 (i.e., the nozzle forming region 30A) is formed so as to be withdrawn in a recessed shape, the pressing roller 118 is designed as follows. The pressing roller 118 is formed in such a manner that the central portion thereof has an enlarged diameter in accordance with the cross-sectional shape of the nozzle surface 30 of the inkjet head 16 which is the object of cleaning, and the central portion of the pressing roller 118 is thereby formed so as to project (having a larger diameter than other portions) in accordance with the nozzle surface 30 which is formed in the recessed shape. More specifically, the region (the region which abuts during a wiping operation) corresponding to the nozzle forming region 30A which is withdrawn in the recessed shape is formed so as to project (expand) in accordance with the amount of withdrawal. By this means, it is possible to press the wiping web 110 appropriately against the nozzle forming region 30A which is formed in the withdrawn recessed shape. In the present embodiment, as described below, the pressing roller 118 is caused to vibrate, and therefore it is necessary to adopt a design in which the projecting portion of the pressing roller 118 fits into the recessed portion of the nozzle surface 30, and does not cause an impact even if the roller is vibrated. Moreover, desirably, the nozzle arrangement in the recessed portion of the nozzle surface 30 is designed accordingly, in such a manner that it can be wiped by the web pressed by the projecting portion of the pressing roller 118. Furthermore, the pressing roller 118 can also be formed as a smooth cylinder with no projecting portions. In this case, both the web and the pressing roller, or the web only, are caused to deform by a force which presses the pressing roller against the nozzle surface, and the web is placed in contact with the nozzles in the recessed portion and performs a wiping action. Consequently, the pressure which pushes the web against the nozzles should be set so as to account for deformation.

The pressing roller 118 is provided with axle portions 118L and 118R, which project on either end portion thereof, and the axle portions 118L and 118R are supported by a pair of axle supporting sections 146L and 146R in a rotatable and swingable fashion. The pressing roller 118 can be raised and lowered by a mechanism constituted of members 170, 172, 174, 176, 178 and 182 in FIGS. 7 to 12.

Figure 13:
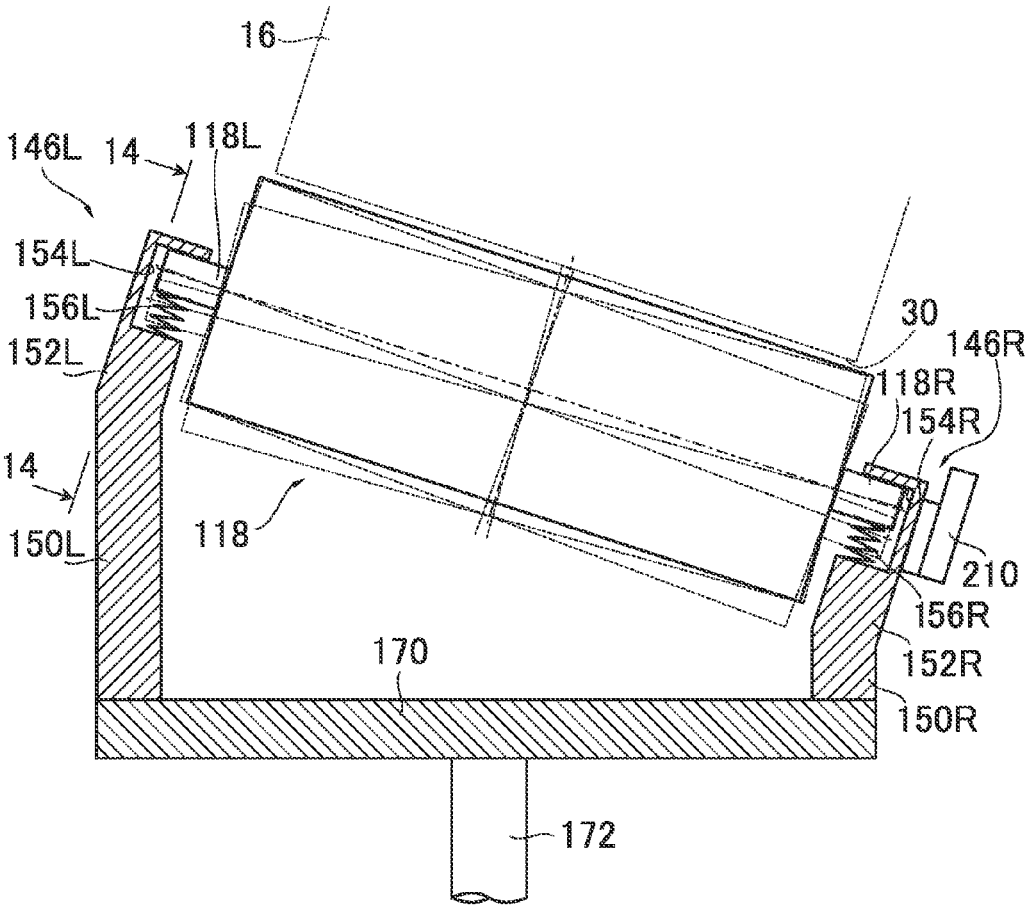
FIG. 13 is a partial cross-sectional front view diagram showing the composition of a bearing section which supports an axle section of a pressing roller.
Figure 14:
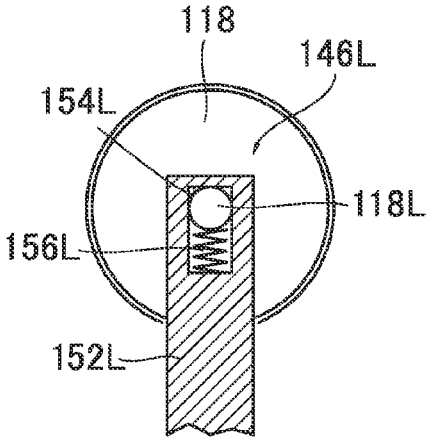
FIG. 14 is a cross-sectional view along line 14-14 in FIG. 13.

FIG. 13 is a partial cross-sectional front view diagram showing the composition of the axle supporting sections which support the axle sections 118L and 118R of the pressing roller 118, and FIG. 14 is a cross-sectional diagram along line 14-14 in FIG. 13.

As shown in FIG. 13, the axle supporting sections 146L and the 146R are arranged on an elevator stage 170, which is horizontally disposed. The axle supporting sections 146L and 146R are constituted of pillar sections 150L and 150R, which are vertically erected on the elevator stage 170, and supporting sections 152L and 152R, which are arranged in a bent fashion at the top ends of the pillar sections 150L and 150R.

The supporting sections 152L and 152R are arranged perpendicularly to the axle of the pressing roller 118, and recess sections 154L and 154R are formed in the inner sides thereof. Each of the recess sections 154L and 154R is formed in a rectangular shape, which has a breadth substantially equal to the diameter of each of the axle sections 118L and 118R of the pressing roller 118, and the lengthwise direction thereof is perpendicular to the nozzle surface of the inkjet head that is to be cleaned (see FIG. 14). The axle sections 118L and 118R on either end of the pressing roller 118 are fitted freely into the recess sections 154L and 154R of the supporting sections 152L and 152R. Thus, the pressing roller 118 is supported swingably within the plane perpendicular to the nozzle surface of the inkjet head that is to be cleaned.

Springs 156L and 156R are accommodated inside the recess sections 154L and 154R, and the axle sections 118L and 118R of the pressing roller 118 which are fitted freely inside the recess sections 154L and 154R are pressed upward by the springs 156L and 156R. By this means, it is possible to cause the circumferential surface of the pressing roller 118 to make close contact with the nozzle surface, by following the nozzle surface of the line head that is to be cleaned.

As shown in FIG. 13, a vibration device 210 which causes fine vibration of the pressing roller 118 is arranged on the axle supporting section 146R, which supports the axle section 118R of the pressing roller 118. By causing the pressing roller 118 to vibrate in a direction following the axle sections 118L and 118R by means of the vibration device 210, it is possible to cause the wiping web 110 to vibrate. Since the nozzle surface of the inkjet head which is the object of cleaning makes close contact with the pressing roller 118 as stated above, then it is possible to wipe the nozzle surface in a different direction to the direction of movement of the inkjet head 16, by causing the wiping web 110 to vibrate.

The vibration device 210 can be constituted of an actuator, as shown in FIG. 13. For the actuator, it is possible to use a piezoelectric actuator, a solenoid actuator using an electromagnet, a parallel flat plate type electrostatic actuator using an electrostatic force, a comb-shaped electrostatic actuator, or the like, or a thermal bimorph actuator which uses heat, or the like.

It is also possible to use other vibration methods, such as a method which carries out vibration by driving an eccentric cam with a motor, or a method which carries out vibration by means of a linear motor.

The front-stage guide 120 is constituted of a first front-stage guide 160 and a second front-stage guide 162, and the wiping web 110 paid out from the pay-out spindle 114 is guided so as to wrap about the pressing roller 118, which is obliquely disposed.

On the other hand, the rear-stage guide 122 is constituted of a first rear-stage guide 164 and a second rear-stage guide 166, and the wiping web 110 which has been wrapped about the pressing roller 118 obliquely disposed is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is vertically erected on the elevator stage 170. The upper edge portion 160A of the first front-stage guide 160 is formed as a supporting section for the wiping web 110, and the surface thereof is formed in a circular arc shape. Furthermore, the upper edge portion 160A is formed at a prescribed angular inclination with respect to the horizontal plane, whereby the travel direction of the wiping web 110 is changed.

The first rear-stage guide 164 has the same composition as the first front-stage guide 160. More specifically, the first rear-stage guide 164 is formed in a plate shape having a prescribed width and is vertically erected on the elevator stage 170. The upper edge portion 164A is formed as a supporting section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The travel direction of the wiping web 110 which has been paid out from the pay-out spindle 114 is changed to a direction substantially perpendicular to the axis of the pressing roller 118 from the direction perpendicular to the axis of the pay-out spindle 114, by wrapping the wiping web 110 about the first front-stage guide 160. The travel direction of the wiping web 110 having been wrapped about the second rear-stage guide 166 described below is changed to a direction perpendicular to the axis of the take-up spindle 116 by wrapping the wiping web 110 about the first rear-stage guide 164.

The second front-stage guide 162 is formed as a guide roller having flanges 162L and 162R on the respective end portions thereof. The second front-stage guide 162 is disposed between the first front-stage guide 160 and the pressing roller 118, and guides the wiping web 110 which has wrapped about the first front-stage guide 160 so as to be wrapped about the pressing roller 118. More specifically, the travel direction of the wiping web 110 which has been changed to the direction substantially perpendicular to the axis of the pressing roller 118 by the first front-stage guide 160 is slightly adjusted so that the wiping web 110 travels in the direction just perpendicular to the axis of the pressing roller 118. Furthermore, skewed travel of the wiping web 110 is prevented by the flange sections 162L and 162R on the respective ends of the first front-stage guide 160.

Figure 15:
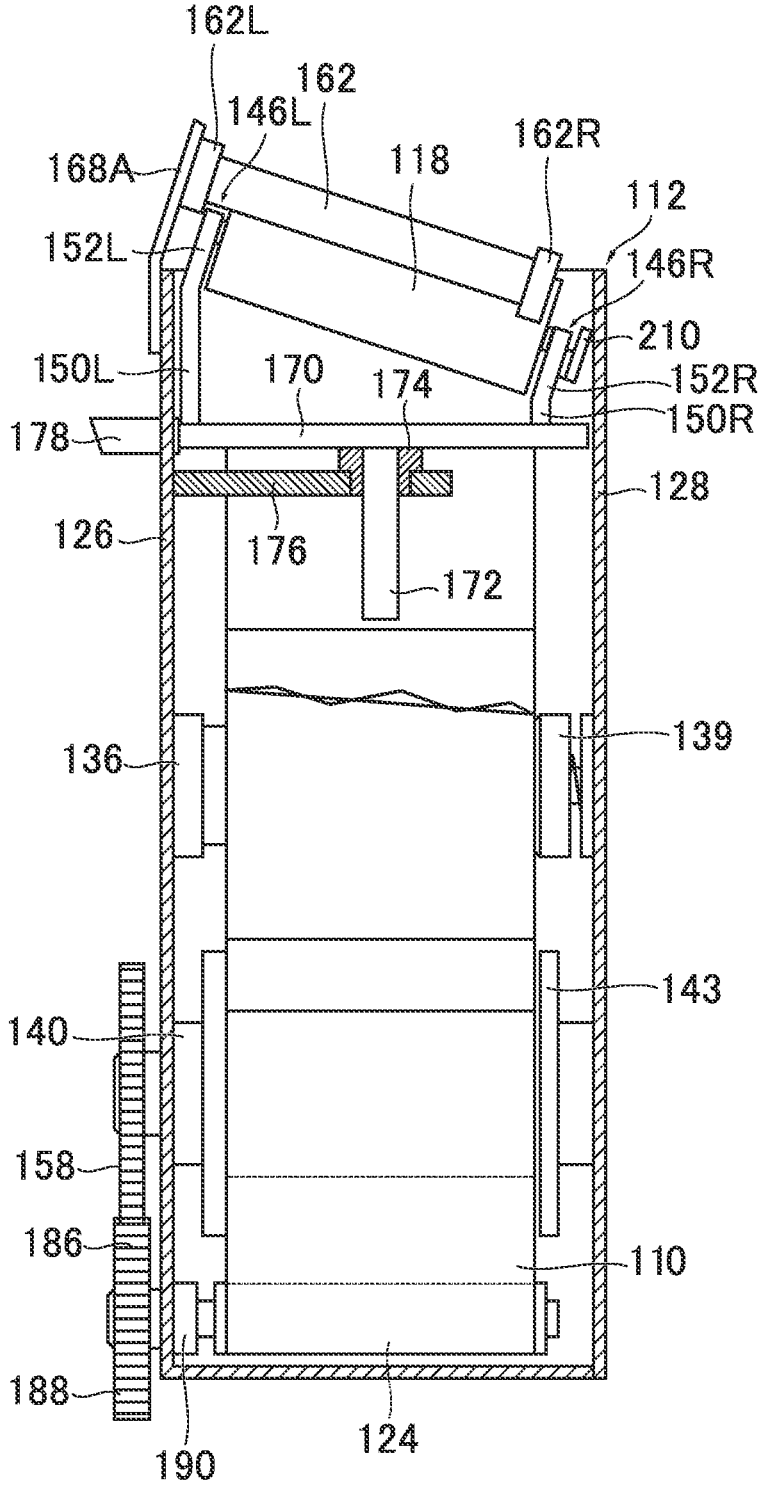
FIG. 15 is a cross-sectional view along line 15-15 in FIG. 11.

The second front-stage guide 162 is supported at only one end thereof on a bracket 168A, and the second front-stage guide 162 is disposed at a prescribed angular inclination. As shown in FIGS. 12 and 15, the bracket 168A is formed in a plate shape with a bent top end, and the base end portion of the bracket 168A is fixed to the upper end portion of the rear face of the case main body 126. The bracket 168A is arranged so as to project perpendicularly upward from the upper end portion of the case main body 126. The second front-stage guide 162 is rotatably supported at only one end thereof on the bent portion of the top end of the bracket 168A.

The second rear-stage guide 166 has the same composition as the second front-stage guide 162. More specifically, the second rear-stage guide 166 is formed as a guide roller having flanges 166L and 166R on either end portion thereof, and the second rear-stage guide 166 is supported at only one end thereof on a bracket 168B. The second rear-stage guide 166 is arranged at a prescribed angular inclination. The bracket 168B is formed in a plate shape with a bent top end, and the base end portion of the bracket 168B is fixed to the upper end portion of the rear face of the case main body 126. The second rear-stage guide 166 is rotatably supported at only one end thereof on the bent portion of the top end of the bracket 168B.

The second rear-stage guide 166 is disposed between the pressing roller 118 and the first rear-stage guide 164, and guides the wiping web 110 which has been wrapped about the pressing roller 118 so as to be wrapped about the first rear-stage guide 164.

The second front-stage guide 162 and the second rear-stage guide 166 are disposed symmetrically about the pressing roller 118. The wiping web 110 of which the travel direction has been changed to the direction substantially perpendicular to the axis of the pressing roller 118 by the first front-stage guide 160 is wrapped about the second front-stage guide 162, whereby the travel direction of the wiping web 110 is slightly adjusted so that the wiping web 110 travels in the direction just perpendicular to the axis of the pressing roller 118. Furthermore, the travel direction of the wiping web 110 having been wrapped about the pressing roller 118 is slightly adjusted by the second rear-stage guide 166 so that the wiping web 110 can be wrapped about the first rear-stage guide 164. By wrapping the wiping web 110 about the first rear-stage guide 164, the travel direction of the wiping web 110 is changed to the direction perpendicular to the axis of the take-up spindle 116.

Thus, the front-stage guide 120 and the rear-stage guide 122 guide the wiping web 110 by gradually changing the travel direction of the wiping web 110, so that the wiping web 110 can be wrapped about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

Action of Nozzle Surface Cleaning Apparatus

<First Embodiment>

Next, a nozzle surface cleaning operation performed by the nozzle surface cleaning apparatus 60 in the present embodiment is described.

The cleaning of the nozzle surfaces is performed while the inkjet heads 16C, 16M, 16Y and 16K are moved from the maintenance position to the image recording position.

When a nozzle surface cleaning instruction is input to the controller, the controller moves the cleaning liquid deposition device 62 and the nozzle surface wiping device 64 to the prescribed operating positions. By this means, it becomes possible for the cleaning liquid deposition device 62 to deposit cleaning liquid and for the nozzle surface wiping device 64 to perform wiping.

After the cleaning liquid deposition device 62 and the nozzle surface wiping device 64 have been moved to the prescribed operating positions, the controller causes the head supporting frame 40 to move from the maintenance position to the image recording position at a prescribed movement speed.

On the other hand, the controller also drives the cleaning liquid supply pump in accordance with the timing at which the inkjet heads 16C, 16M, 16Y and 16K arrive at the cleaning liquid deposition heads 74 of the cleaning liquid deposition units 70C, 70M, 70Y and 70K. Thereby, the cleaning liquid is ejected at a prescribed flow rate from the cleaning liquid emission ports 78 of the cleaning liquid deposition heads 74 arranged in the respective cleaning liquid deposition units 70C, 70M, 70Y and 70K. The ejected cleaning liquid removes foreign matter from the nozzle surfaces 30C, 30M, 30Y and 30K, and is deposited onto the nozzle surfaces 30C, 30M, 30Y and 30K. The cleaning liquid which has flowed over the cleaning liquid holding surfaces 74A of the cleaning liquid deposition heads 74 contacts the nozzle surfaces 30C, 30M, 30Y and 30K, and the cleaning liquid is also thereby deposited on the nozzle surfaces 30C, 30M, 30Y and 30K.

The nozzle surfaces 30C, 30M, 30Y and 30K on which the cleaning liquid has been deposited are moved in this state toward the image recording position. In passing the wiping units 100C, 100M, 100Y and 100K, the nozzle surfaces 30C, 30M, 30Y and 30K are cleaned by wiping.

The controller drives the motors 194 and causes the wiping webs 110 to travel, in accordance with the timing at which the inkjet heads 16C, 16M, 16Y and 16K arrive at the wiping units 100C, 100M, 100Y and 100K. Thereby, the traveling wiping webs 110 are pressed against the nozzle surfaces 30C, 30M, 30Y and 30K, thus wiping and cleaning the nozzle surfaces 30C, 30M, 30Y and 30K.

<<Wiping Operation>>

The whole of the wiping device 64 is arranged raisable and lowerable. When not performing cleaning, the nozzle surface wiping device 64 is disposed in a prescribed standby position. During cleaning, the nozzle surface wiping device 64 is raised by a prescribed amount from the standby position to a prescribed operating position.

When the nozzle surface wiping device 64 is moved to the operating position, the nozzle surfaces 30C, 30M, 30Y and 30K of the inkjet heads 16C, 16M, 16Y and 16K can be wiped by the wiping units 100C, 100M, 100Y and 100K. More specifically, when the inkjet heads 16C, 16M, 16Y and 16K pass the respective wiping units 100C, 100M, 100Y and 100K, it is possible for the wiping webs 110 wound about the pressing rollers 118 to be pressed against the nozzle surfaces 30C, 30M, 30Y and 30K.

When the inkjet heads 16C, 16M, 16Y and 16K in which the cleaning liquid has been deposited on the nozzle surfaces 30C, 30M, 30Y and 30K by the cleaning liquid deposition device 62 are moved past the wiping units 100C, 100M, 100Y and 100K, the wiping webs 110 wrapped around the pressing rollers 118 are respectively pressed against the nozzle surfaces 30C, 30M, 30Y and 30K. Thereby, the nozzle surfaces 30C, 30M, 30Y and 30K are wiped.

The controller drives the motors 194 and causes the wiping webs 110 to travel, in accordance with the timing at which the inkjet heads 16C, 16M, 16Y and 16K arrive at the wiping units 100C, 100M, 100Y and 100K. Thereby, the traveling wiping webs 110 are pressed against the nozzle surfaces 30C, 30M, 30Y and 30K, thus wiping and cleaning the nozzle surfaces 30C, 30M, 30Y and 30K by means of the traveling wiping webs 110.

Figure 16:
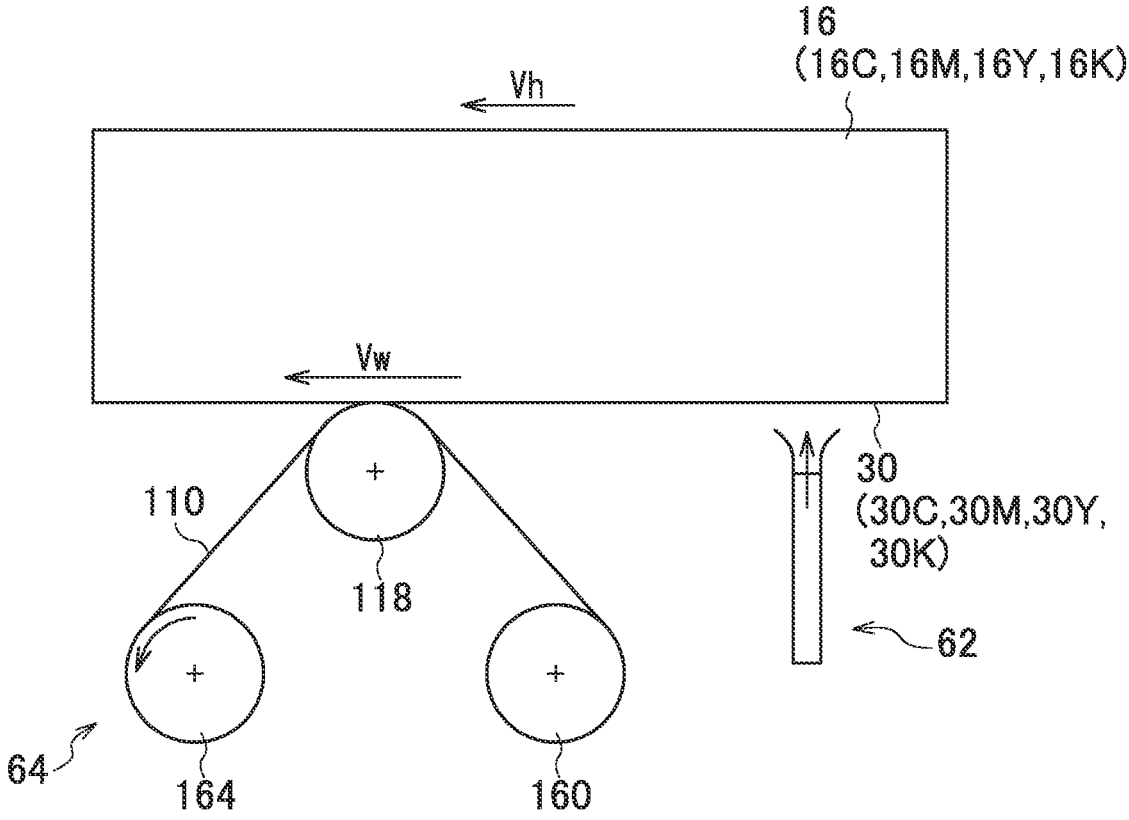
FIG. 16 is a diagram for describing a nozzle surface cleaning method in a first embodiment.

During this, as shown in FIG. 16, the wiping web 110 wipes the nozzle surfaces 30C, 30M, 30Y and 30K while traveling in the same direction as the direction of movement of the inkjet heads 16C, 16M, 16Y and 16K. In FIGS. 16 to 19B, the nozzle surface wiping device 64 is depicted in simplified form, and the second front-stage guide 162 and the second rear-stage guide 166 are not shown. There are no particular restrictions on the speed of movement of the inkjet heads 16C, 16M, 16Y and 16K, and the speed of movement of the wiping web 110. Furthermore, the direction of movement of the inkjet heads 16C, 16M, 16Y and 16K and the direction of movement of the wiping web 110 are the same direction in FIG. 16, but they may also be opposite directions. In this case, wiping is performed while the inkjet heads 16C, 16M, 16Y and 16K are moved from the image recording position to the maintenance position.

For example, as shown in FIG. 16, when the speed of movement of the inkjet heads 16C, 16M, 16Y and 16K is Vh and the speed of movement of the wiping web is Vw, then if Vh<Vw, the wiping direction is the same as the direction of movement of the inkjet heads 16C, 16M, 16Y and 16K. Furthermore, the pressing roller 118 is caused to finely vibrate in the direction perpendicular to the direction of movement of the wiping web 110 by means of the vibration device 210. Consequently, it is possible to perform wiping of the nozzle surfaces in the plurality of directions, and therefore foreign matter can be removed in an efficient manner.

Figure 17B:
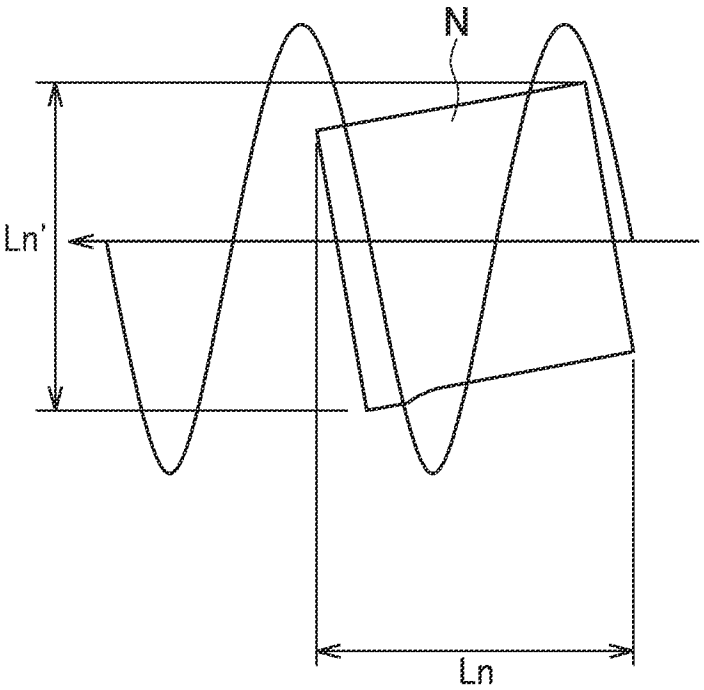
FIGS. 17A and 17B are diagrams for describing the wiping direction of a wiping web.
Figure 17A:
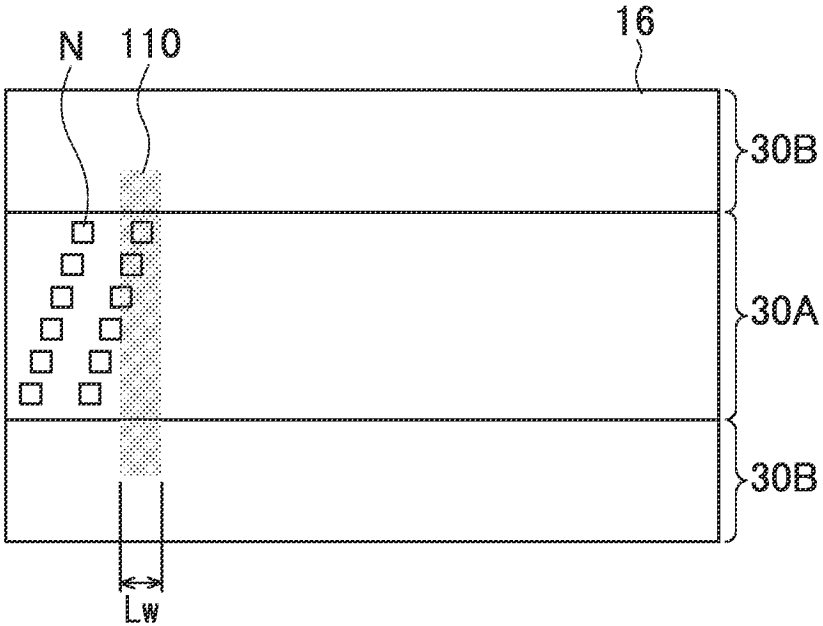

FIGS. 17A and 17B are diagrams which illustrate the wiping direction by the wiping web 110 when the pressing roller 118 is caused to finely vibrate. By causing the pressing roller 118 to finely vibrate, it is possible to cause the wiping web 110 to vibrate, in the a parallel to the plane in which the inkjet head 16 is moved, and in a direction perpendicular to the direction of movement of the inkjet head 16, and therefore wiping can be performed in the plurality of directions, as shown in FIG. 17B.

With regard to the frequency of vibration of the pressing roller 118 by the vibration device 210, when the dimension of the nozzle N with respect to the direction of travel of the wiping web 110 is Ln, the dimension of the contact plane between the wiping web 110 and the nozzle surface 30 (the dimension of the contact surface through which the wiping web 110 contacts the nozzle surface 30 by being pressed with the pressing roller 118) in the direction of movement of the inkjet head 16 is Lw, and the speed of movement of the nozzle surface 30 is Vh, as shown in FIGS. 17A and 17B, then in order to wipe the nozzle surface 30 in the direction perpendicular to the direction of travel of the wiping web 110, it is necessary to carry out vibration with at least a half period during the passage of the wiping web 110 through the nozzle width Ln, and it is then desirable that the frequency f is set so as to satisfy:

$$f \geq Vh/(2\times(Ln+Lw)). \quad (1)$$

For example, in a case where Ln=20 μm, Lw=1 mm and Vh=10 mm/sec, it is desirable to set the frequency to f≥4.9 Hz.

Furthermore, in order to wipe away foreign matter inside the nozzles, it is desirable that the amplitude of vibration of the pressing roller 118 by the vibration device 210 is not less than the nozzle width Ln' (see FIG. 17B). However, if the amplitude of vibration is too large, then creases may occur in the wiping web 110 when the wiping web 110 is taken up onto the take-up spindle 116, and the take-up action may not be correctly performed.

By using the band-shaped webs as the wiping members, it is possible to wipe the nozzle surfaces 30C, 30M, 30Y and 30K using new surfaces of the webs at all times.

The wiping webs 110 each travel in the following manner.

When the motor 194 is driven, the rotation of the motor 194 is transmitted to the take-up spindle drive gear 158 and the grid roller drive gear 186 through the drive gear 192 and the rotation transmission gear 188. Thereby, the take-up spindle 116 and the grid roller 124 rotate.

When the grid roller 124 rotates, the conveyance action is applied to the wiping web 110 and the wiping web 110 is paid out from the pay-out core 138. The wiping web 110 is then conveyed toward the take-up core 142.

In so doing, as described above, friction is applied to the pay-out core 138, and therefore it is possible to pay-out the wiping web 110 without the occurrence of slackness, even if there is a sudden change in tension in the wiping web 110.

Furthermore, due to the rotation of the take-up spindle drive gear 158, the take-up core 142 rotates and accordingly the wiping web 110 is taken up.

In the manner described above, the wiping web 110 can be made to travel by driving the motor 194. By pressing the traveling wiping web 110 against the nozzle surface in this way, the nozzle surface is wiped by the wiping web 110.

The wiping web 110 that has finished wiping is wound up on the take-up core 142 as described above.

When the nozzle surfaces 30C, 30M, 30Y and 30K have completely passed the cleaning liquid deposition units 70C, 70M 70Y and 70K, the controller halts the driving of the cleaning liquid supply pump, and halts the supply of cleaning liquid. Thereupon, the controller withdraws the cleaning liquid deposition device 62 to the standby position.

When the nozzle surfaces 30C, 30M, 30Y and 30K have completely passed the wiping units 100C, 100M, 100Y and 100K, the controller halts the driving of the motors 194, and halts the travel of the wiping webs 110. Thereupon, the controller withdraws the nozzle surface wiping device 64 to the standby position.

The cleaning of the nozzle surfaces 30C, 30M, 30Y and 30K of the inkjet heads 16C, 16M, 16Y and 16K is completed by the series of steps described above.

As described above, in the nozzle surface cleaning apparatus 60 according to the present embodiment, the cleaning liquid is deposited onto the nozzle surfaces 30C, 30M, 30Y and 30K by the cleaning liquid deposition device 62, whereupon the nozzle surfaces 30C, 30M, 30Y and 30K are wiped by the nozzle surface wiping device 64, thus cleaning the nozzle surfaces 30C, 30M, 30Y and 30K. Thus, it is possible reliably to remove soiling, and the like, which is adhering to the nozzle surfaces 30C, 30M, 30Y and 30K.

<Second Embodiment>

Figure 18A:
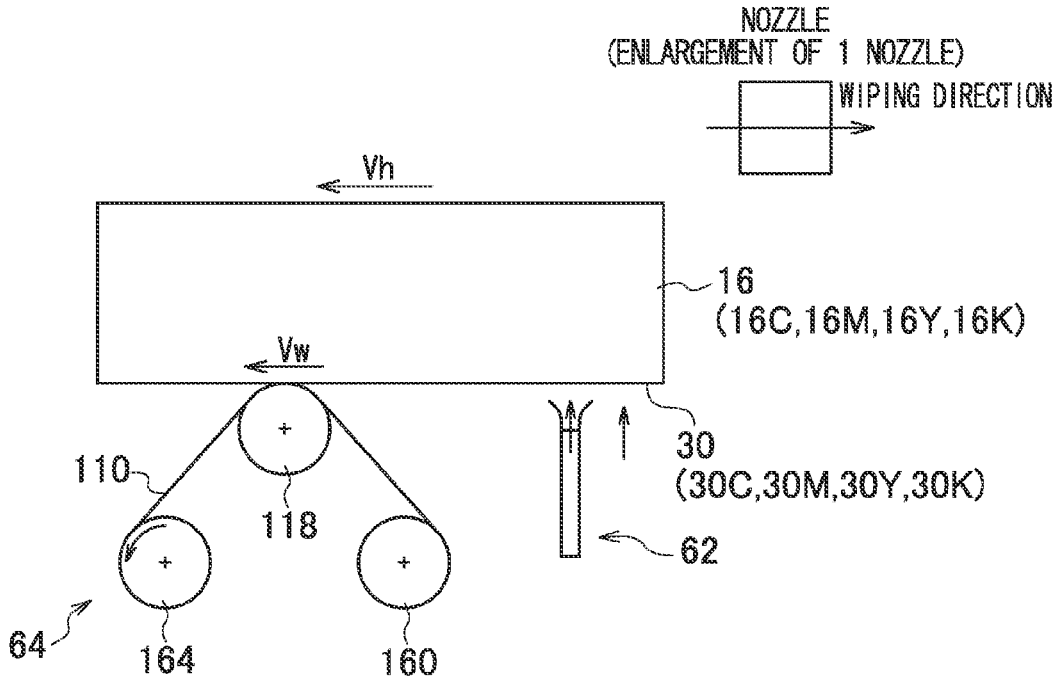
FIGS. 18A and 18B are diagrams for describing a nozzle surface cleaning method in a second embodiment.
Figure 18B:
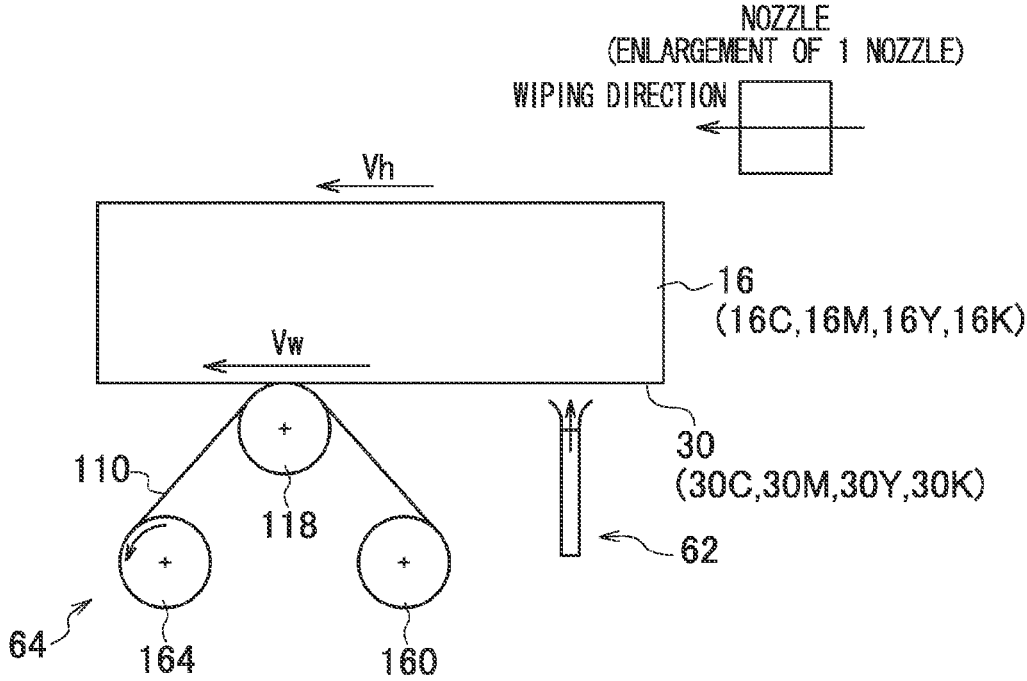

FIGS. 18A and 18B show a wiping method of the nozzle surfaces 30C, 30M, 30Y and 30K according to a second embodiment. In the wiping method in the second embodiment, the direction of movement of the inkjet heads 16C, 16M, 16Y and 16K and the direction of movement of the wiping webs 110 are the same direction, and the wiping is performed by changing the speed of movement Vh of the inkjet heads 16C, 16M, 16Y and 16K and the speed of movement Vw of the wiping webs 110.

In the wiping method in the second embodiment also, the cleaning of the nozzle surfaces 30C, 30M, 30Y and 30K is performed while the inkjet heads 16C, 16M, 16Y and 16K are moved from the maintenance position to the image recording position.

As shown in FIG. 18A, for example, the nozzle surfaces 30C, 30M, 30Y and 30K are cleaned by carrying out wiping of the nozzle surfaces 30C, 30M, 30Y and 30K under conditions where the speed of movement Vh of the inkjet heads 16C, 16M, 16Y and 16K is greater than the speed of movement Vw of the wiping webs 110. By carrying out wiping under conditions where Vh>Vw, the wiping direction is opposite to the direction of movement of the nozzle surfaces 30C, 30M, 30Y and 30K and the direction of movement of the wiping webs 110.

Next, as shown in FIG. 18B, by carrying out wiping under conditions where Vh<Vw, the wiping direction is the same as the direction of movement of the inkjet heads 16C, 16M, 16Y and 16K and the direction of movement of the wiping webs 110. The wiping is carried out while moving the wiping webs 110 by the vibration device in the same plane in the direction perpendicular to the direction of movement of the wiping webs 110. The speed of movement of the nozzle surfaces 30C, 30M, 30Y and 30K and the wiping webs 110 can be changed in any order, and there is no particular restriction on the number of times that the speeds of movement are changed.

Thus, by carrying out the wiping respectively under the conditions where Vn>Vw and the conditions where Vh<Vw, it is possible to carry out the wiping in the wiping directions, and therefore the effects of removing foreign matter can be improved.

In the present embodiment, the wiping is carried out while the inkjet heads 16C, 16M, 16Y and 16K are moved from the maintenance position to the image formation position, and therefore it is necessary to return the inkjet heads 16C, 16M, 16Y and 16K from the image forming position to the maintenance position after carrying out the wiping of the nozzle surfaces 30C, 30M, 30Y and 30K.

Furthermore, by moving the nozzle surfaces 30C, 30M, 30Y and 30K in one direction, it is possible to carry out the wiping by arranging the cleaning liquid deposition device 62 only on one side of the nozzle surface wiping device 64, and therefore the apparatus can be simplified.

<Third Embodiment>

Figure 19A:
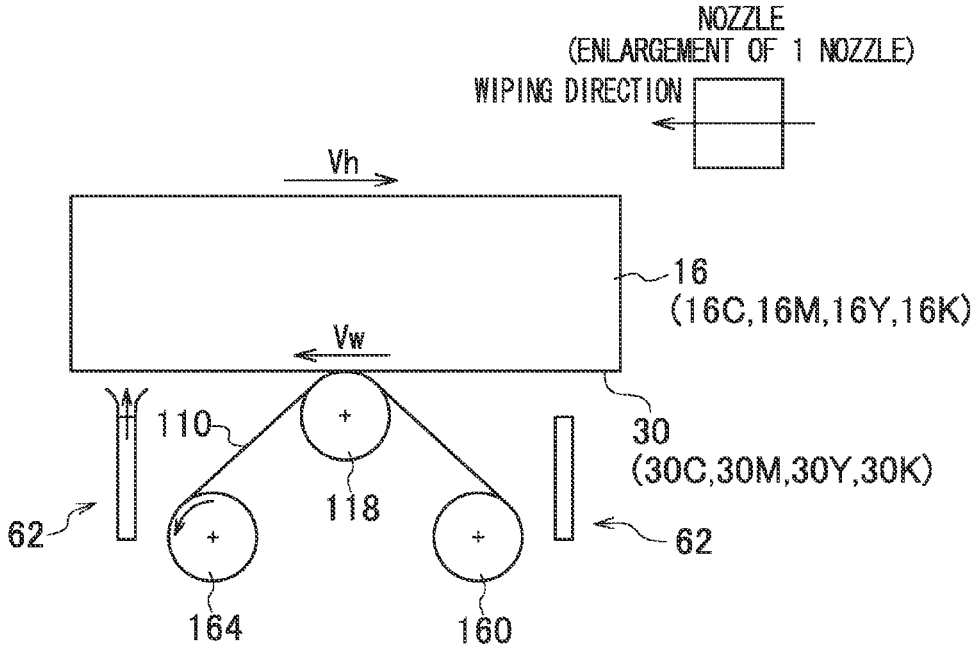
FIGS. 19A and 19B are diagrams for describing a nozzle surface cleaning method in a third embodiment.
Figure 19B:
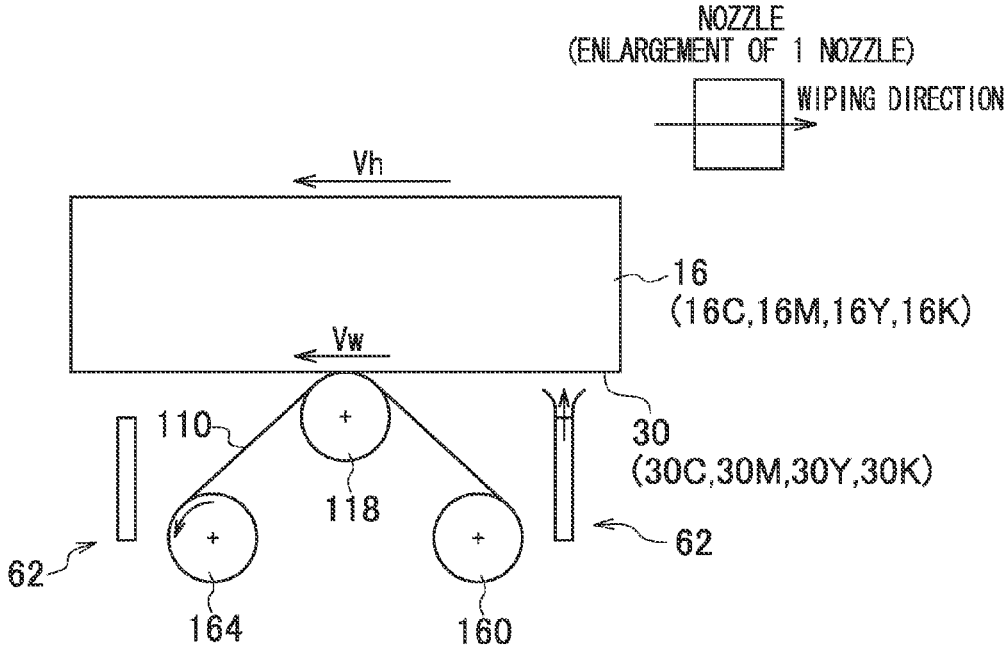

FIGS. 19A and 19B show a wiping method of the nozzle surfaces 30C, 30M, 30Y and 30K according to a third embodiment. The wiping method in the third embodiment includes a step of performing wiping by setting the direction of movement of the inkjet heads 16C, 16M, 16Y and 16K and the direction of movement of the wiping webs 110 to be opposite to each other, and a step of performing wiping by setting the direction of movement of the inkjet heads 16C, 16M, 16Y and 16K and the direction of movement of the wiping webs 110 to the same direction while setting Vh>Vw, wiping being carried out at least once under each of these conditions. In the third embodiment, the inkjet heads 16C, 16M, 16Y and 16K are moved from either side of the nozzle surface cleaning apparatus 64, and therefore it is necessary to arrange the cleaning liquid deposition devices 62 on both sides of the nozzle surface wiping device 64.

In the third embodiment, nozzle cleaning is carried out in both directions: during moving of the inkjet heads 16C, 16M, 16Y and 16K from the maintenance position to the image recording position and during movement of the inkjet heads 16C, 16M, 16Y and 16K from the image recording position to the maintenance position. It is also possible to make the direction of movement of the inkjet heads 16C, 16M, 16Y and 16K uniform and to change the direction of movement of the wiping webs 110, but if the wiping webs 110 are moved in the opposite direction, then the nozzle surfaces 30C, 30M, 30Y and 30K are wiped again with the wiping webs 110 that have already performed wiping, and this is not desirable.

By carrying out wiping with the direction of movement of the inkjet heads 16C, 16M, 16Y and 16K and the direction of movement of the wiping webs 110 set to opposite directions, it is possible to set the wiping direction to be opposite to the direction of movement of the inkjet heads 16C, 16M, 16Y and 16K, as shown in FIG. 19A. Furthermore, by setting the direction of movement of the inkjet heads 16C, 16M, 16Y and 16K and the direction of movement of the wiping webs 110 to the same direction, and setting Vh>Vw, it is possible to set the wiping direction to be opposite to the direction of movement of the inkjet heads 16C, 16M, 16Y and 16K.

Consequently, as shown in FIGS. 19A and 19B, it is possible to change the wiping direction of the nozzle surfaces 30C, 30M, 30Y and 30K, and since the wiping webs 110 are also caused to vibrate, then it is possible to carry out wiping in the plurality of directions and it is also possible to improve the effect of removing foreign matter. Furthermore, it is possible to carry out wiping during reciprocal movement of the inkjet heads 16C, 16M, 16Y and 16K in the course of movement from the maintenance position to the image recording position and the course of movement from the image recording position to the maintenance position, and therefore it is possible to shorten the wiping time.

<Fourth Embodiment>

Next, a fourth embodiment of the present invention is described with reference to FIGS. 20 to 26. In the following description, parts which are the same as or similar to the preceding descriptions are denoted with the same reference numerals and further explanation thereof is omitted here.

Figure 20:
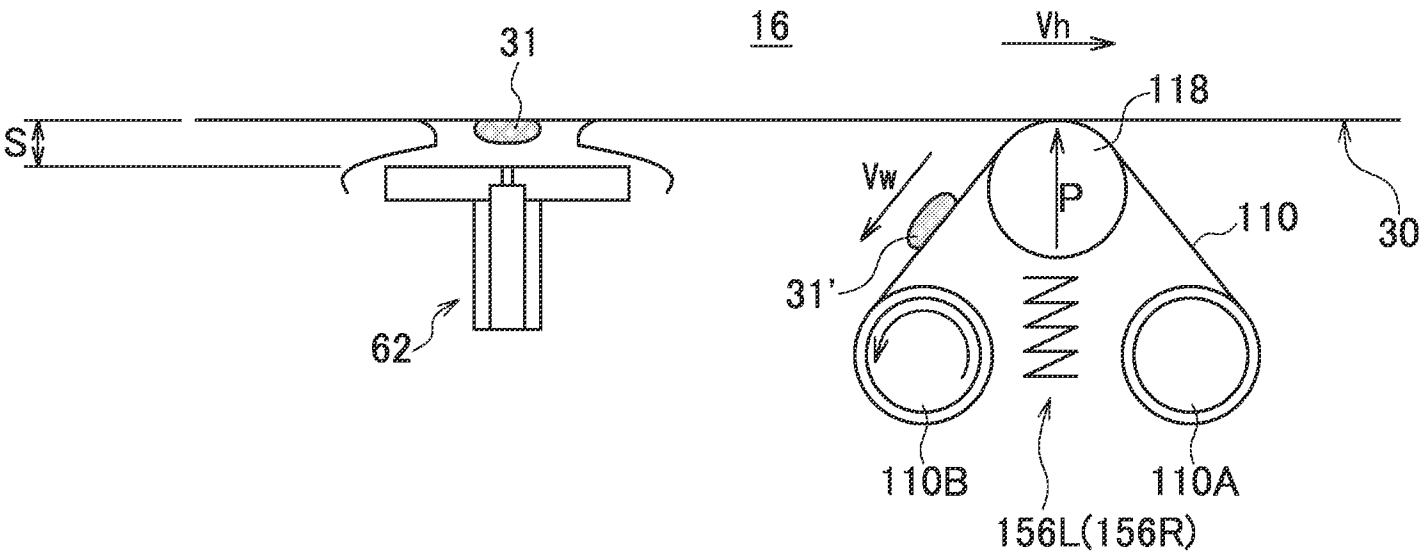
FIG. 20 is a diagram for describing a nozzle surface cleaning method relating to a fourth embodiment.

FIG. 20 is an illustrative diagram showing a schematic view of a method of wiping the nozzle surfaces 30 according to the present embodiment. As shown in FIG. 20, a long wiping web 110 is employed for an operation of wiping the nozzle surface 30. The wiping web 110 is moved from a pay-out side roll 110A to a take-up side roll 110B by the web conveyance motor 194 (see FIG. 7), and new wiping web 110 is pressed against the nozzle surface 30 at all times, thereby removing adhering material 31 from the nozzle surface 30.

In FIG. 20, the adhering material (ink, and the like) which has been removed from the nozzle surface 30 by the wiping web 110 is denoted with the reference numeral 31'.

The cleaning liquid is deposited on the nozzle surface 30 from the cleaning liquid deposition device 62, and wiping is performed by the wiping web 110 after the nozzle surface 30 has been wetted by the cleaning liquid. A prescribed clearance S is provided between the nozzle surface 30 and the cleaning liquid deposition device 62, and the cleaning liquid is deposited without making the cleaning liquid deposition device 62 in contact with the nozzle surface 30.

The wiping web 110 is pressed by the pressing roller 118 from the opposite side to the nozzle surface 30, with a prescribed pressure in the upward direction indicated with the arrow P. FIG. 20 shows a mode where the spring force is applied by the springs 156L and 156R, as an example of a device which presses the wiping web 110 against the nozzle surface 30 by the pressing roller 118.

Here, when the speed of the inkjet head 16 is Vh and the speed of the wiping web 110 is Vw, then the relative speed V of the inkjet head 16 and the wiping web 110 is expressed as V=Vh−Vw. The direction of the arrow indicating the speed Vh of the inkjet head 16 is defined as the positive direction.

Since the speed Vw of the wiping web 110 is in the negative direction, then the relative speed V of the inkjet head 16 and the wiping web 110 in FIG. 20 is V=Vh−(−Vw)=Vh+Vw. For example, if Vh=40 mm/s and Vw=4 mm/s, then V=40−(−4)=44 mm/s.

Figure 21A:
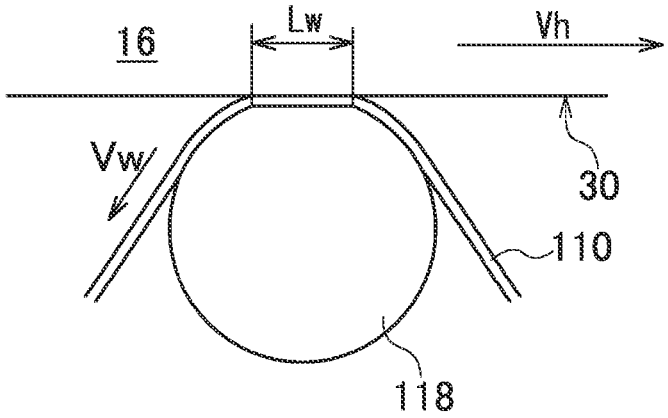
FIGS. 21A to 21C are diagrams for describing the abutment width of a wiping web.
Figure 21B:
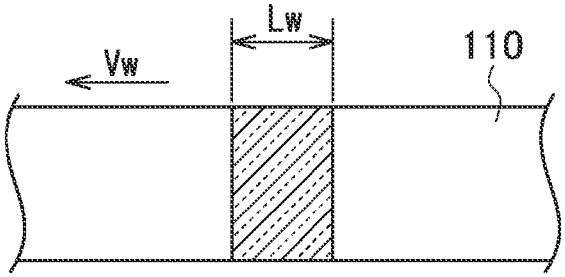
Figure 21C:
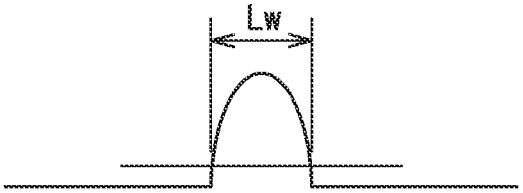

FIGS. 21A to 21C are illustrative diagrams of the abutment width between the nozzle surface 30 and the wiping web 110 (pressing roller 118). A material of low hardness, such as silicone rubber or the like, is employed for the surface of the pressing roller 118, and the pressing roller 118 is abutted against the nozzle surface 30 across the wiping web 110 at the required pressure limit for wiping the nozzle surface 30.

FIG. 21A is a diagram showing a state of the pressing roller 118 (wiping web 110) pressed against the nozzle surface 30, as viewed in the width direction of the inkjet head 16, and FIG. 21B is a plan diagram of the wiping web 110 (viewing the surface which abuts against the nozzle surface 30).

As shown in FIGS. 21A and 21B, the pressing roller 118 pressed against the nozzle surface 30 elastically deforms and has a prescribed abutment width Lw in the direction of relative movement of the inkjet head 16 and the wiping web 110.

For example, when the outer diameter of the pressing roller 118 is 20 mm, the hardness of the surface of the pressing roller 118 is 5°, and the pressing force is 20 kPa ($20\times10^3$ N/m$^2$), then the abutment width Lw between the nozzle surface 30 and the pressing roller 118 (wiping web 110) is 4 mm. The abutment width Lw between the nozzle surface 30 and the pressing roller 118 depends on the hardness of the pressing roller 118 and the pressing force applied to the pressing roller 118, and can be determined experimentally.

FIG. 21C shows a pressure profile when the pressing roller 118 is pressed against the nozzle surface 30 with the prescribed abutment width Lw.

The abutment width Lw is the dimension exceeding the maximum dimension of the nozzles N (see FIG. 3), and at least one nozzle N is included in the abutment width Lw. The maximum dimension of the nozzle N is the length of the diagonal when the nozzle aperture has the quadrilateral shape, and is the diameter when the nozzle aperture has the circular shape.

Figure 22A:
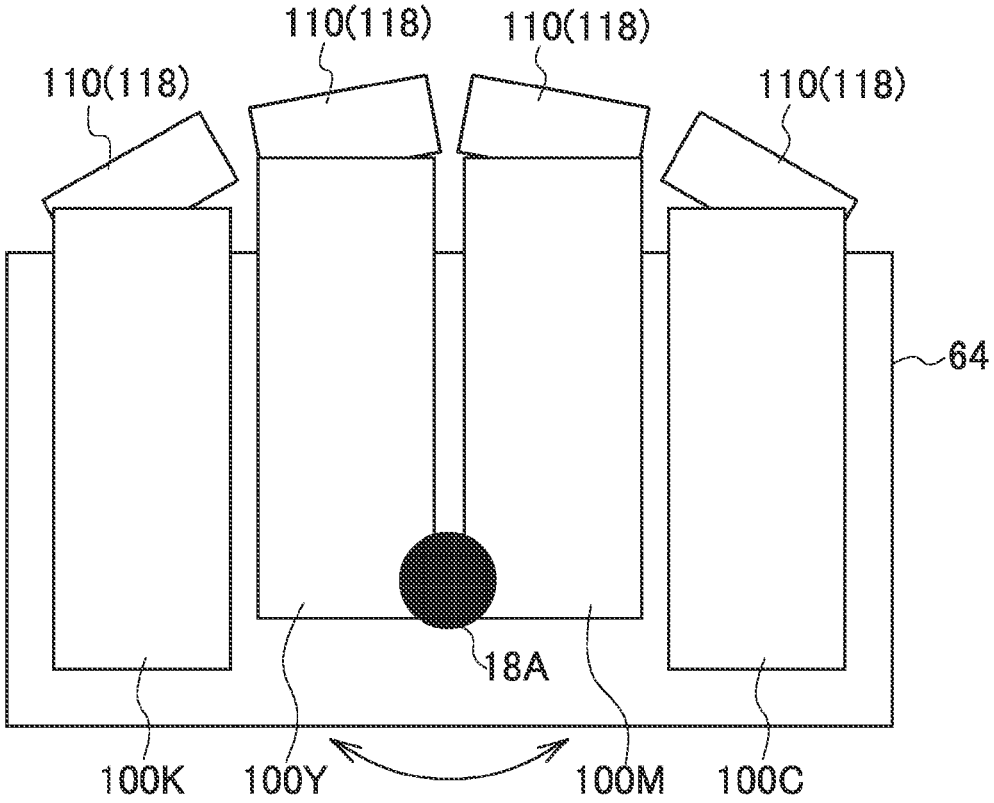
FIGS. 22A and 22B are illustrative diagrams showing schematic views of a composition for reciprocally moving the wiping web.
Figure 22B:
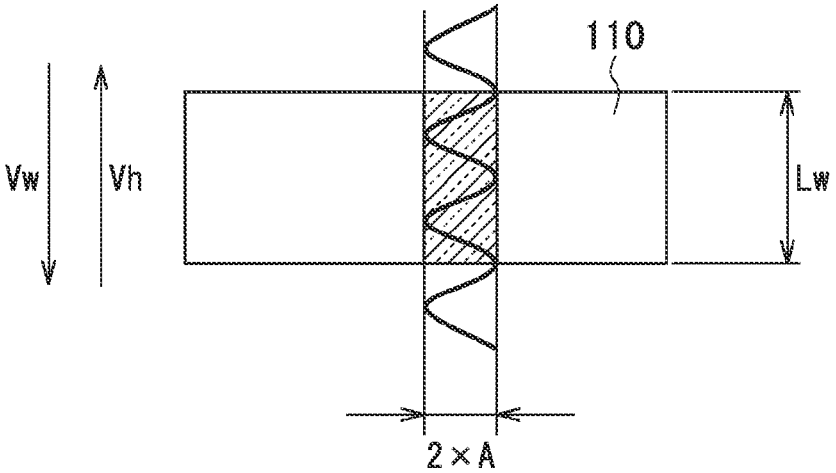

FIGS. 22A and 22B are illustrative diagrams showing schematic views of a composition for reciprocally moving (vibrating, shaking) the wiping web 110 (pressing roller 118), in a direction which is substantially perpendicular to the relative movement direction of the inkjet head 16 and the wiping web 110.

As stated previously, the nozzle surface wiping device 64 shown in FIG. 22A has the wiping units 100C, 100M, 100Y and 100K corresponding to the respective inkjet heads 16 (16C, 16M, 16Y and 16K, see FIG. 1), and is supported swingably about a swinging axle 18A, which is an extension of the rotational axle 18 of the image recording drum 14 (see FIG. 1).

Thus, by swinging the nozzle surface wiping device 64 about the swinging axle 18A, it is possible to move the wiping webs 110 reciprocally in the direction substantially perpendicular to the relative movement direction of the inkjet heads 16 and the wiping webs 110.

FIG. 22B is a diagram showing the conditions of reciprocal movement of the wiping web 110 in the direction substantially perpendicular to the relative movement direction of the inkjet head 16 and the wiping web 110. As shown in FIG. 22B, the abutment width of the nozzle surface 30 and the wiping web 110 is Lw (mm), the speed of movement of the inkjet head 16 is Vh (mm/s), the speed of conveyance of the wiping web 110 is Vw (mm/s), the frequency of reciprocal movement of the wiping web 110 is f (Hz), and the width of reciprocal movement of the wiping web 110 is 2×A (mm).

The conditions for moving the wiping web 110 back and forth at least once during passage through the abutment width Lw between the nozzle surface 30 and the wiping web 110 is as follows:

$$f>(Vh+Vw)/Lw. \tag{2}$$

Figure 23:
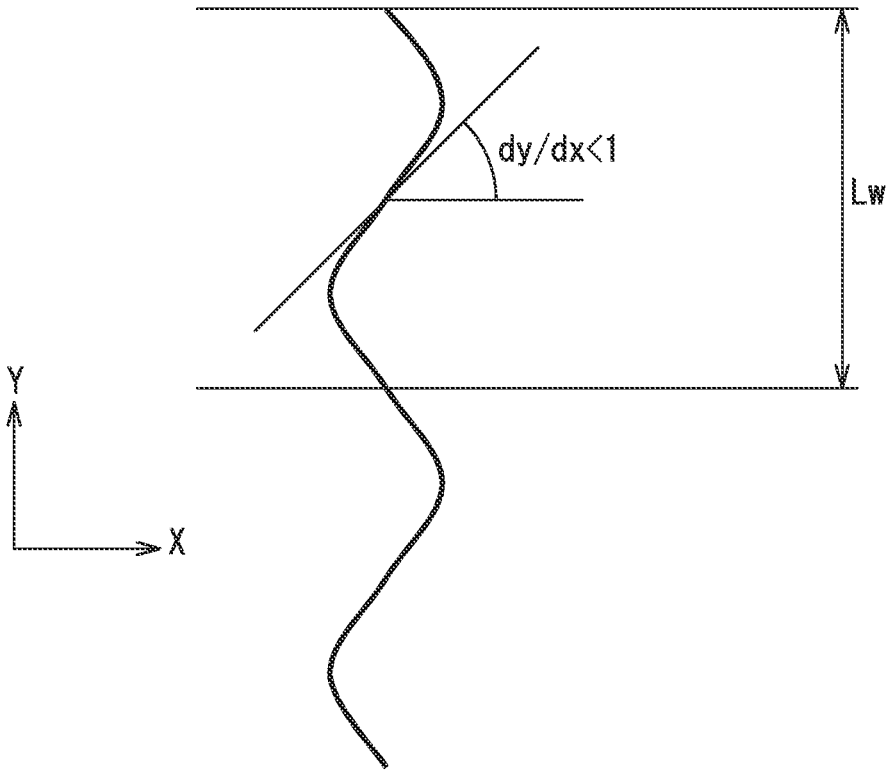
FIG. 23 is an illustrative diagram showing conditions for achieving multi-directional wiping of the wiping web.

FIG. 23 is an illustrative diagram showing a schematic view of conditions where the direction of reciprocal movement of the wiping web 110 is changed through 90° or more, with respect to the direction of relative movement between the inkjet head 16 and the wiping web 110. When the wiping web 110 is moved reciprocally in the y direction while being moved the x direction shown in FIG. 23, then this is equivalent to the wiping web 110 moving in a substantially sinusoidal path with respect to the nozzle surface 30.

Here, when the gradient dy/dx of the substantially sinusoidal path at the point of origin O satisfies the condition of dy/dx<1, the direction of reciprocal movement of the wiping web 110 changes in excess of 90° with respect to the direction of relative movement of the inkjet head 16 and the wiping web 110.

More specifically, when the inkjet head 16 and the wiping web 110 are moved relatively through Lw in the x direction, then it is necessary to satisfy the condition dy/dx<1 in order to move the wiping web 110 back and forth at least once in the y direction.

When the amount of movement of the wiping web 110 in the y direction per unit time t is Y, then Y=(Vw+Vh)×t. Furthermore, when the amount of movement of the wiping web 110 in the x direction per unit time t is X, then X=A×sin(2×π×f×t).

Then, dy/dx can be modified as dy/dx=(dy/dt)×(dt/dx)=(Vw+Vh)×A/(2×π×f), and dy/dx<1 can be represented as:

$$f\times A>(Vw+Vh)/(2\times\pi). \tag{3}$$

Consequently, wiping in a plurality of directions with respect to the nozzle surface 30 is achieved by setting the frequency f and the amplitude A so as to satisfy the above-described Formulae (2) and (3).

For example, when the speed of movement Vh of the inkjet head is 20 mm/s, the speed of movement Vw of the wiping web 110 is 4 mm/s and the abutment width Lw is 4 mm, then the frequency f and the amplitude A are necessary to satisfy f>6 Hz and A>0.38 mm, and are practically set to values of f=10 Hz and A=0.5 mm.

As described above, according to the nozzle cleaning apparatus and method in the fourth embodiment, by moving (vibrating) the wiping web 110 reciprocally in the substantially perpendicular direction with respect to the direction of relative movement of the inkjet head 16 and the wiping web 110, wiping is performed in multiple directions with respect to the nozzle surface 30 (nozzles N), residue of adhering material in the opening sections of the nozzles N and the vicinity of the opening sections of the nozzles N is prevented, and satisfactory wiping of the nozzle surface 30 is achieved.

Although FIG. 17B shows the example where the nozzles N have a substantially square opening shape, but the invention can also be applied to nozzles having substantially circular openings, by substituting the nozzle diameter for the nozzle dimensions Ln and Ln'.

Concrete Embodiments of Composition for Causing Wiping Web to Vibrate

<First Embodiment>

Figure 24:
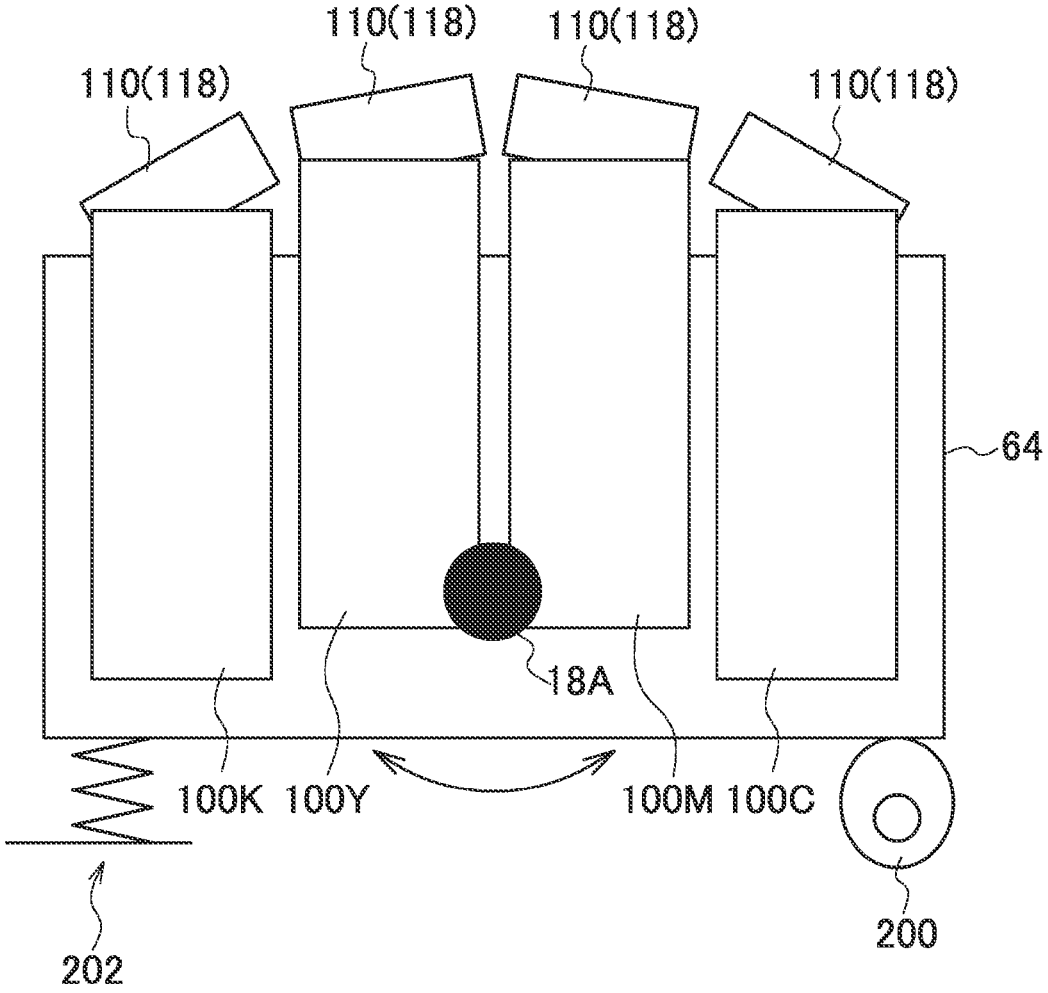
FIG. 24 is a schematic drawing showing a first concrete embodiment relating to vibration of a web unit.

FIG. 24 is an illustrative diagram showing a schematic view of a composition in a first embodiment which moves the wiping webs 110 reciprocally in the direction substantially perpendicular to the direction of relative movement of the inkjet heads 16 and the wiping webs 110. In the embodiment shown in FIG. 24, the nozzle surface wiping device 64 is held on the swinging fulcrum (swinging axle) 18A, and an eccentric cam 200 and a spring (elastic impelling member) 202 are used as a swinging mechanism.

More specifically, the eccentric cam 200 is arranged on one end of the nozzle surface wiping device 64 in the direction of swinging of the wiping webs 110 (the direction indicated with the arrow), the spring 202 is arranged on the other end thereof, and by rotating the eccentric cam 200, the nozzle surface wiping device 64 is caused to swing about the swinging fulcrum 18A, and the wiping webs 110 can be moved reciprocally in the direction substantially perpendicular to the direction of relative movement of the inkjet heads 16 and the wiping webs 110.

The eccentric cam 200 satisfies the frequency f conditions described above, by rotating at a speed exceeding f revolutions per second (rps).

Instead of the eccentric cam 200, it is also possible to adopt a mode which includes a star-shaped cam having a plurality of projecting shapes, the star-shaped cam being rotated at a speed corresponding to the number of projecting shapes. For example, when a star-shaped cam having six projecting sections performs one revolution per second, then the nozzle surface wiping device 64 swings at 6 Hz, and the wiping webs 110 move reciprocally at 6 Hz in the direction substantially perpendicular to the direction of relative movement of the inkjet heads 16 and the wiping webs 110.

In order to fix the positions of the wiping units 100C, 100M, 100Y and 100K which are mounted on the nozzle surface wiping device 64, a desirable mode is one which includes a locking mechanism for locking the eccentric cam 200.

According to the first embodiment, by causing the whole of the nozzle surface wiping device 64 to swing, it is possible to cause the wiping units 100C, 100M, 100Y and 100K to swing in unison, and hence the composition of the swinging mechanism and the swinging control do not become complicated.

In the present embodiment, when the nozzle surface wiping device 64 is caused to swing about the swinging fulcrum 18A, the abutment width Lw of the wiping web 110 varies, but since the value of the amplitude A of swinging is extremely small, then the amount of swinging which creates variation of the abutment width Lw is also small, and the abutment width Lw is not affected.

<Second Embodiment>

Next, a second embodiment of a composition for moving the wiping webs 110 reciprocally in the direction substantially perpendicular to the direction of relative movement of the inkjet heads 16 and the wiping webs 110 is described.

Figure 25:
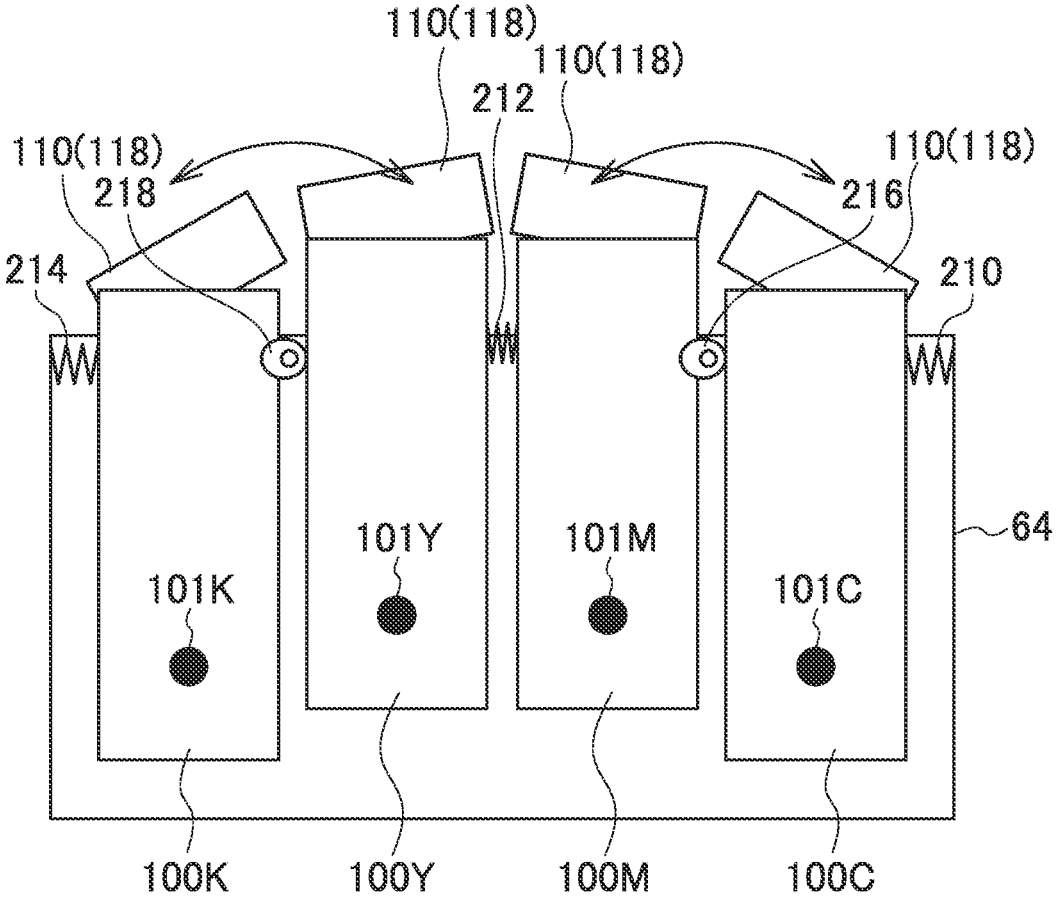
FIG. 25 is a schematic drawing showing a second concrete embodiment relating to vibration of a web unit.

FIG. 25 is an illustrative diagram showing a schematic view of the composition in the second embodiment. In the embodiment shown in FIG. 25, the wiping units 100C, 100M, 100Y and 100K are independently held on swinging axles (swinging fulcrums) 101C, 101M, 101Y and 101K, respectively, in such a manner that the wiping units 100C, 100M, 100Y and 100K are independently swingable.

More specifically, the frame of the nozzle surface wiping device 64 and the wiping unit 100C on one end side are coupled by a spring 210, and the central wiping units 100M and 100Y are coupled by a spring 212. Furthermore, the frame of the nozzle surface wiping device 64 and the wiping unit 100K on the other end side are coupled by a spring 214.

An eccentric cam 216 is arranged between the wiping unit 100C on one end side and the central wiping unit 100M, and an eccentric cam 218 is arranged between the central wiping 100Y and the wiping unit 100K on the other end side.

When the eccentric cam 216 is rotated, the wiping units 100C and 100M are caused to swing respectively as indicated by the arrows. Furthermore, when the eccentric cam 218 is rotated, the wiping units 100Y and 100K are caused to swing respectively as indicated by the arrows.

The swinging fulcrums 101C, 101M, 101Y and 101K of the wiping units 100C, 100M, 100Y and 100K can be determined experimentally.

According to the second embodiment, it is possible to reduce the load (moment of inertia) on the drive system (motor, etc.) of one swinging mechanism, and the composition of the drive system can be made compact.

<Third Embodiment>

Next, a third embodiment of a composition for moving the wiping webs 110 reciprocally in the direction substantially perpendicular to the direction of relative movement of the inkjet heads 16 and the wiping webs 110 is described.

Figure 26:
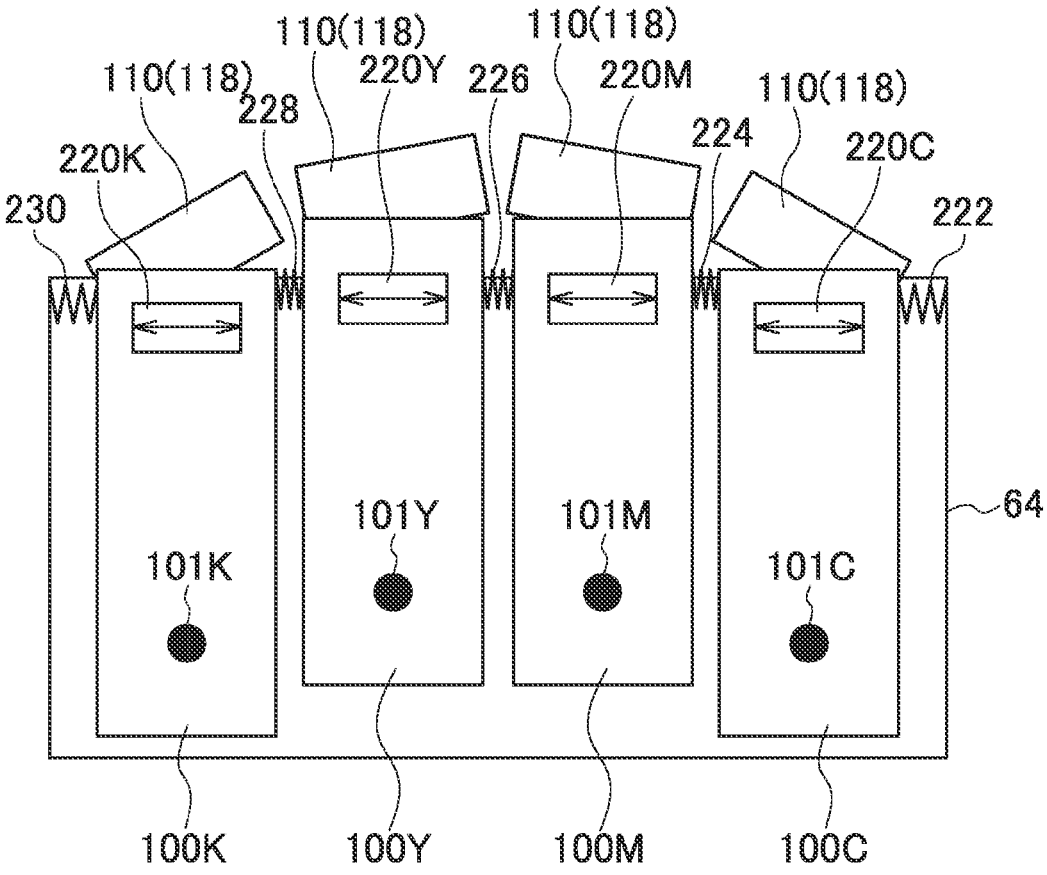
FIG. 26 is a schematic drawing showing a third concrete embodiment relating to vibration of a web unit.

FIG. 26 is an illustrative diagram showing a schematic view of the composition in the third embodiment. In the embodiment shown in FIG. 26, the wiping units 100C, 100M, 100Y and 100K are independently held on the swinging axles (swinging fulcrums) 101C, 101M, 101Y and 101K, respectively, and vibration motors (linear motors) 220C, 220M, 220Y and 220K are arranged respectively for the wiping units 100C, 100M, 100Y and 100K.

Moreover, the frame (not illustrated) of the nozzle surface wiping device 64 and the wiping unit 100C are coupled by a spring 222, the wiping units 100C and 100M are coupled by a spring 224, the wiping units 100M and 100Y are coupled by a spring 226, the wiping units 100Y and 100K are coupled by a spring 228, and the wiping unit 100K and the frame (not illustrated) of the nozzle surface wiping device 64 are coupled by a spring 230.

The vibration motors 220C, 220M, 220Y and 220K are fixed by holding members (not illustrated) which hold the wiping units 100C, 100M, 100Y and 100K in an integrated fashion.

The composition shown in FIG. 26 enables the wiping units 100C, 100M, 100Y and 100K to be caused to swing independently to each other in the directions of the double-headed arrows in FIG. 26.

According to the composition which causes the wiping units 100C, 100M, 100Y and 100K to vibrate directly using the vibration motors 220C, 220M, 220Y and 220K, it is possible to cause the wiping units 100C, 100M, 100Y and 100K to vibrate at high speed, and the relative speed of movement of the inkjet heads 16 and the wiping webs 110 can be increased, thus giving the expectation of shorter wiping process time.

For example, when the vibration motors 220C, 220M, 220Y and 220K are driven to vibrate at 50 Hz, the relative movement speed of the inkjet heads 16 and the wiping webs 110 can be set to 200 mm/s.

On the other hand, when the relative speed of movement of the inkjet heads 16 and the wiping webs 110 is 40 mm/s, then A>0.127 mm in order to satisfy the condition of the above-described Formula (3), and therefore even if A=0.15 mm, it is possible to satisfy conditions which enable the periphery of the nozzles N to be wiped in the plurality of directions.

By causing the wiping webs 110 to vibrate, it is possible to apply the force of friction from the wiping webs 110 to the adhering material in the plurality of directions, and although dependent on the adhesion strength of the adhering material in the periphery of the nozzles N, beneficial effects in removing the adhering material can be displayed, provided that A=0.15 mm.

If A has a larger value, then the damage caused to the liquid repellent film formed on the nozzle surface 30 becomes larger due to the force of friction of the wiping web 110, and therefore A is set to a range that does not cause damage to the liquid repellent film. The range of A that does not cause damage to the liquid repellent film is determined on the basis of experimentation or simulation.

The springs 222 to 230 can be omitted if the moment of inertia which forms the load of the vibration motors 220C, 220M, 220Y and 220K is small.

Detection Step

The wiping method according to the present invention can be implemented as the strong maintenance method when the normal maintenance method has been carried out without performing fine vibration and it has not been possible to remove the foreign matter with the normal maintenance process. It is possible to carry out wiping by applying fine vibration in the normal maintenance, but there is a possibility of causing damage to the liquid repellent film formed on the nozzle surface, and the nozzle edges, due to the increased number of wiping actions, and the load of the vibrating action. Therefore, it is desirable to perform vibration as the strong maintenance method in cases where there is foreign matter which is difficult to remove.

As a method for detecting foreign matter that cannot be removed by the normal maintenance method, it is possible to carry out the normal maintenance method, and then record an image of a test pattern and check the image.

Furthermore, soiled portions of the nozzle surface are checked in advance by using a CCD camera, or the like, and wiping can be carried out by using the strong maintenance method of the present invention in portions where there is severe soiling.

Composition of Nozzle Surface Wiping Device According to Further Embodiments

In the above-described embodiments, the inkjet heads for the drum conveyance are described. Therefore, the composition is described in which the nozzle surface wiping device 64 is inclined in accordance with the shape of the nozzle surface of the inkjet head. The present invention is not limited to this shape of the inkjet head, and can also be used in an inkjet head having a nozzle surface which is horizontal with respect to the belt, as in an inkjet head based on a belt conveyance method.

Figure 27:
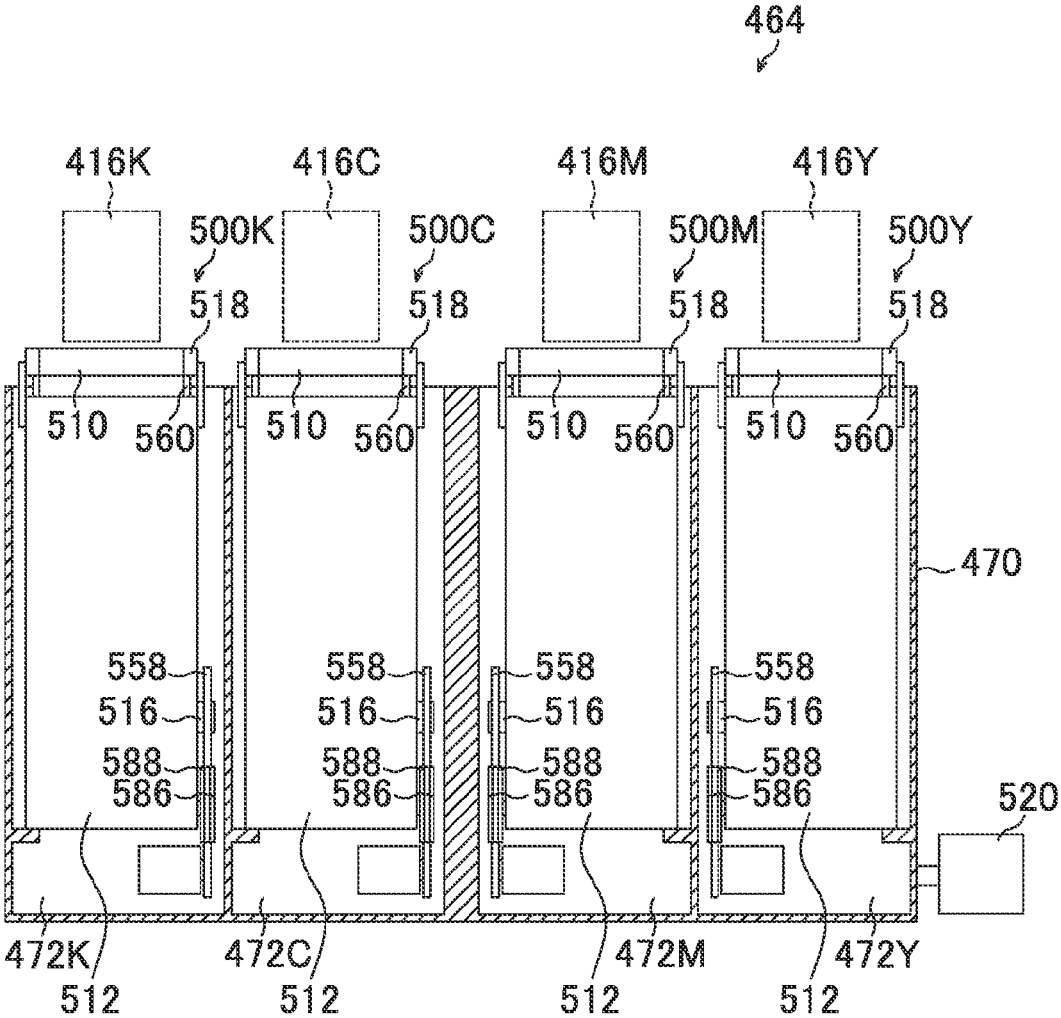
FIG. 27 is a diagram for describing a nozzle surface cleaning method in a further embodiment.

FIG. 27 shows a side view of a nozzle surface wiping device 464 according to a further embodiment. The nozzle surface wiping device 464 shown in FIG. 27 can be used for wiping of the nozzle surfaces of inkjet heads 416C, 416M, 416Y and 416K in which the nozzle surfaces are parallel to the installation plane. The composition of the nozzle surface wiping device shown in FIG. 27 is substantially the same as the composition of the nozzle surface wiping device 64 described above, but differs in respect of the fact that pressing rollers 518 lie in the direction parallel to the installation plane, in accordance with the nozzle surfaces of the inkjet heads 416C, 416M, 416Y and 416K.

Wiping units 500C, 500M, 500Y and 500K which are arranged respectively for the inkjet heads 416C, 416M, 416Y and 416K are set on a main body frame 470. The wiping units 500C, 500M, 500Y and 500K also have the same composition as the wiping units 100C, 100M, 100Y and 100K described above, and are each constituted of wiping webs 510, pressing rollers 518, pay-out spindles (not illustrated), take-up spindles 516, drive rollers (not illustrated), and the like.

Furthermore, in the present embodiment, a vibration device 520 is arranged on the main body frame 470. As the vibration device 520, it is possible to use a composition similar to the vibration device described above. In the present embodiment, all of the nozzle surfaces of the inkjet heads 416C, 416M, 416Y and 416K are arranged parallel to the installation plane, and therefore it is possible to carry out wiping in a plurality of directions and foreign matter can be removed, by causing wiping webs 510 to vibrate in the same plane in the different direction with respect to the direction of movement of the wiping webs 510 by the vibration device 520 arranged on the main body frame 470.

Application Embodiment

Next, an application embodiment of the present invention is described with reference to FIGS. 28A and 28B.

Figure 28B:
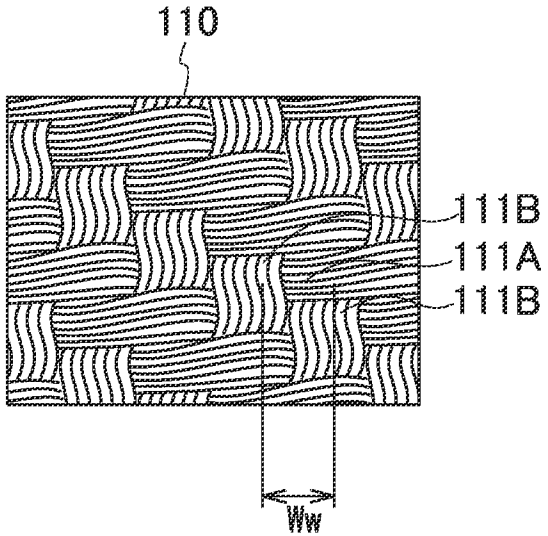
FIGS. 28A and 28B are diagrams for describing wiping surfaces of wiping webs.
Figure 28A:
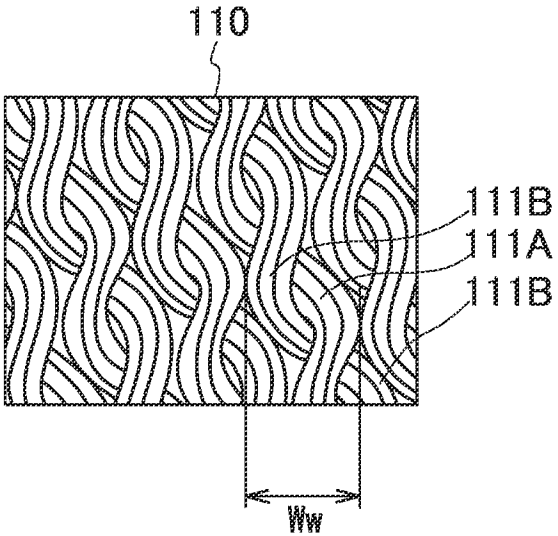
Figure 29A:
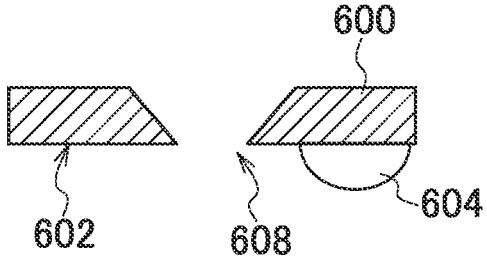
FIG.29A RELATED ART
FIGS. 29A to 29D are diagrams for describing problems in the related art.
Figure 29B:
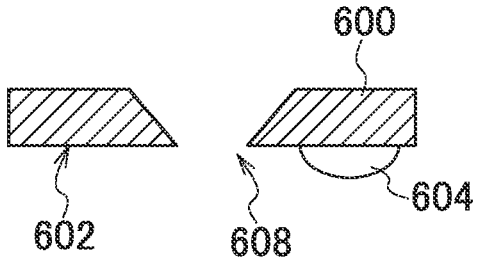
FIG.29B RELATED ART
Figure 29C:
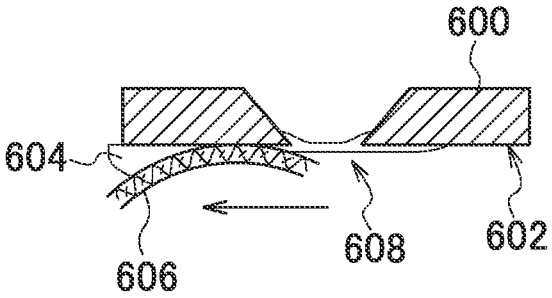
FIG.29C RELATED ART
Figure 29D:
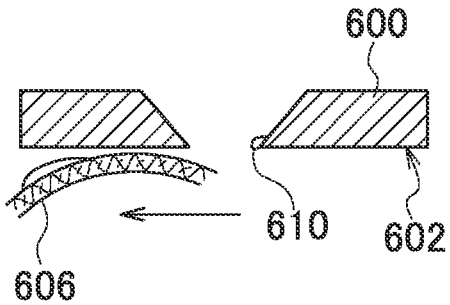
FIG.29D RELATED ART

FIGS. 28A and 28B are diagrams showing enlarged views of the wiping surfaces of the wiping webs 110. FIG. 28A shows a web of fibers in a satin weave, and FIG. 28B shows a web of fibers in a diagonal weave.

As shown in FIGS. 28A and 28B, the wiping webs 110 are made of cloth fibers and have undulations due to the weaving patterns; recess portions 111A function as absorbing layers which take in liquid, and projecting portions 111B function to generate force to wipe away solidified material.

Then, it is desirable, in view of wiping away solidified material, to move the projecting sections 111B in a greater number of directions in the vicinity of the nozzles N. On the other hand, if the movement of the projecting sections 111B is very small, then there is a concern that satisfactory wiping is not performed.

For the wiping webs 110 applied to the present invention, it is suitable to use a cloth of small fibers which are not liable to generate dust and have a diameter of approximately 10 μm. As shown in FIGS. 28A and 28B, the small fibers are gathered together and woven, and therefore the width Ww of the weave is approximately several hundred micrometers.

By making the reciprocal movement distance 2×A of the wiping webs 110 greater than the weave width Ww, the wiping can be performed to reliably remove adhering material in the periphery of the nozzles N. More specifically, satisfactory wiping is carried out when the relationship between the weave width Ww of the wiping web 110 and the reciprocal movement distance 2×A of the wiping web 110 in the direction substantially perpendicular to the direction of relative movement between the inkjet head 16 and the wiping web 110 satisfy:

$$A > Ww/2. \tag{4}$$

Furthermore, in the mode where the wiping is carried out by placing the wiping web 110 between the pressing roller 118 and the nozzle surface 30, desirable wiping is achieved by adopting a composition in which no slipping occurs between the pressing roller 118 and the wiping web 110 but slipping does occur between the wiping web 110 and the nozzle surface 30. More specifically, desirable wiping is achieved when the relationship between the slipping coefficient of friction μhw between the nozzle surface 30 and the wiping web 110, and the static coefficient of friction μwr between the wiping web 110 and the pressing roller 118, satisfy:

$$\mu hw < \mu wr. \tag{5}$$

It is possible to achieve the state where the static friction between the wiping web 110 and the pressing roller 118 is greater than the slipping friction between the nozzle surface 30 and the wiping web 110, by providing undulations which correspond to the undulations of the wiping web 110, in the surface of the pressing roller 118 which abuts against the wiping web 110.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle surface cleaning apparatus which wipes a nozzle surface of a droplet ejection head, the apparatus comprising:

a wiping member which wipes the nozzle surface in which a nozzle aperture is formed;

a head movement device which causes movement of the droplet ejection head in a head movement plane and in a head movement direction; and a fine vibration device which causes vibration of one of the wiping member and the droplet ejection head in a vibration plane and in a vibration direction, the vibration plane being parallel to the head movement plane, the vibration direction being different to the head movement direction.

2. The nozzle surface cleaning apparatus as defined in claim 1, wherein the vibration direction is substantially perpendicular to the head movement direction.

3. The nozzle surface cleaning apparatus as defined in claim 1, wherein a frequency f of the vibration satisfies:

$$f \geq Vh/(2\times(Ln+Lw)),$$

where Vh is a speed of the movement of the droplet ejection head, Ln is a dimension of the nozzle aperture in a direction of travel of the wiping member, and Lw is a dimension of abutment of the wiping member with the nozzle surface in the head movement direction.

4. The nozzle surface cleaning apparatus as defined in claim 1, wherein an amplitude of the vibration is not less than a dimension of the nozzle aperture in a direction perpendicular to the head movement direction.

5. The nozzle surface cleaning apparatus as defined in claim 1, wherein the wiping member is a band-shaped web.

6. The nozzle surface cleaning apparatus as defined in claim 5, further comprising:

a pressing member which presses the wiping member against the nozzle surface;

a wiping member movement device which causes movement of the wiping member in a wiping member movement direction and includes:

a pay-out spindle which pays out the wiping member;

a take-up spindle which takes up the wiping member; and a drive roller which is driven to rotate and conveys, toward the take-up spindle, the wiping member which is wrapped about the pay-out spindle, the pressing member and the take-up spindle; and a main body frame in which the wiping member, the pressing member and the wiping member movement device are arranged.

7. The nozzle surface cleaning apparatus as defined in claim 6, wherein:

the wiping member movement direction is same with the head movement direction; and the nozzle surface cleaning apparatus further comprises a control unit which carries out wiping of the nozzle surface by the wiping member at least once under each of a condition where a speed of the movement of the droplet ejection head is higher than a speed of the movement of the wiping member, and a condition where the speed of the movement of the wiping member is higher than the speed of the movement of the droplet ejection head.

8. The nozzle surface cleaning apparatus as defined in claim 6, further comprising:

a pair of cleaning liquid spraying units which spray cleaning liquid to the nozzle surface and are arranged both sides of a position of wiping of the nozzle surface by the wiping member in terms of the head movement direction; and a control unit which carries out the wiping of the nozzle surface by the wiping member at least once under each of a condition where the head movement direction and the wiping member movement direction are set to be opposite to each other, and a condition where the head movement direction and the wiping member movement direction are set to be same with each other and a speed of the movement of the droplet ejection head is higher than a speed of the movement of the wiping member.

9. The nozzle surface cleaning apparatus as defined in claim 6, wherein the fine vibration device includes a vibration application member which causes at least one of the pressing member and the main body frame to vibrate.

10. The nozzle surface cleaning apparatus as defined in claim 9, wherein the vibration application member includes a piezoelectric actuator.

11. The nozzle surface cleaning apparatus as defined in claim 9, wherein the vibration application member includes an eccentric cam and a motor rotating the eccentric cam.

12. The nozzle surface cleaning apparatus as defined in claim 9, wherein the vibration application member includes a linear motor.

13. The nozzle surface cleaning apparatus as defined in claim 1, further comprising a cleaning liquid spraying unit which sprays cleaning liquid to the nozzle surface and is arranged before a position of wiping of the nozzle surface by the wiping member in terms of the head movement direction.

14. The nozzle surface cleaning apparatus as defined in claim 13, wherein a spraying angle of the cleaning liquid with respect to the nozzle surface is controlled in accordance with a tapering angle of the nozzle aperture.

15. The nozzle surface cleaning apparatus as defined in claim 13, further comprising an ultrasonic wave application device which applies an ultrasonic wave to the cleaning liquid sprayed by the cleaning liquid spraying unit.

16. The nozzle surface cleaning apparatus as defined in claim 15, wherein a frequency of the ultrasonic wave is not lower than 700 kHz.

17. The nozzle surface cleaning apparatus as defined in claim 1, wherein the fine vibration device causes a reciprocal movement of the at least one of the wiping member and the droplet ejection head in forth and back movements in the vibration direction at least once while the droplet ejection head is moved by a dimension of abutment of the wiping member with the nozzle surface in the head movement direction.

18. The nozzle surface cleaning apparatus as defined in claim 17, wherein an amount of one of the forth and back movements satisfies a condition where an angle between the head movement direction and the vibration direction is not less than 90°.

19. The nozzle surface cleaning apparatus as defined in claim 17, wherein an amplitude A of one of the forth and back movements, a speed Vw of the movement of the wiping member, a speed Vh of the movement of the droplet ejection head, a relative speed V of the movement of the droplet ejection head and the movement of the wiping member which is V =Vh −Vw, the dimension Lw of the abutment of the wiping member with the nozzle surface in the head movement direction, and a frequency f of the vibration satisfy:

$$f > V/Lw; \text{ and}$$

$$A > (Vw+Vh)/(2\times\pi\times f).$$

20. The nozzle surface cleaning apparatus as defined in claim 1, wherein:

the wiping member is a sheet-shaped web having absorbing characteristics with respect to liquid; and the nozzle surface cleaning apparatus further comprising a pressing member which has a surface that deforms elastically and is in contact with the web to press the web against the nozzle surface by pressing the web from a side of the web opposite to a side of the web that is in contact with the nozzle surface.

21. The nozzle surface cleaning apparatus as defined in claim 20, wherein the pressing member includes an elastic roller having a roller shape of which a surface is provided with an elastic member.

22. The nozzle surface cleaning apparatus as defined in claim 20, wherein:

the fine vibration device causes a reciprocal movement of the at least one of the wiping member and the droplet ejection head in forth and back movements in the vibration direction at least once while the droplet ejection head is moved by a dimension of abutment of the wiping member with the nozzle surface in the head movement direction; and an amount of one of the forth and back movements is not less than a width of a weave of the web.

23. The nozzle surface cleaning apparatus as defined in claim 20, wherein a static coefficient of friction between the web and the pressing member exceeds a slipping coefficient of friction between the nozzle surface and the web.

24. A droplet ejection apparatus, comprising:

an droplet ejection head which ejects droplets to a recording medium; and the nozzle surface cleaning apparatus as defined in claim 1.

25. The nozzle surface cleaning apparatus as defined in claim 1, further comprising an elevator device which raises and lowers the wiping member with respect to the nozzle surface.

26. The nozzle surface cleaning apparatus as defined in claim 1, wherein the fine vibration device causes the vibration of the one of the wiping member and the droplet ejection head while keeping the wiping member in contact with the nozzle surface.

27. A maintenance method for a droplet ejection head having a nozzle surface in which a nozzle aperture is formed, the method comprising:

a head movement step of causing movement of the droplet ejection head in a head movement plane and in a head movement direction;

a wiping member movement step of causing movement of the wiping member in a wiping member movement direction to perform wiping of the nozzle surface with the wiping member; and a fine vibration step of causing vibration of one of the wiping member and the droplet ejection head in a vibration plane and in a vibration direction, the vibration plane being parallel to the head movement plane, the vibration direction being different to the head movement direction.

28. The maintenance method as defined in claim 27, wherein:

the wiping member movement direction is same with the head movement direction;

the head movement step and the wiping member movement step include a first step where a speed of the movement of the droplet ejection head is higher than a speed of the movement of the wiping member, and a second step where the speed of the movement of the wiping member is higher than the speed of the movement of the droplet ejection head; and the wiping of the nozzle surface with the wiping member is performed at least once while each of the first step and the second step.

29. The maintenance method as defined in claim 27, wherein:

the head movement step and the wiping member movement step include a first step where the head movement direction and the wiping member movement direction are set to be opposite to each other, and a second step where the head movement direction and the wiping member movement direction are set to be same with each other and a speed of the movement of the droplet ejection head is higher than a speed of the movement of the wiping member; and the wiping of the nozzle surface with the wiping member is performed at least once while each of the first step and the second step.

30. The maintenance method as defined in claim 27, further comprising a detection step of detecting soiling of the nozzle surface, wherein the fine vibration step is performed in accordance with the soiling detected in the detection step.

31. The maintenance method for a droplet ejection head as defined in claim 30, wherein the detection step includes the step of checking an image formed by ejecting fluid from the nozzle surface.

32. The maintenance method for a droplet ejection head as defined in claim 30, wherein the detection step includes the step of checking the nozzle surface with a camera.

33. The maintenance method as defined in claim 27, wherein the fine vibration step includes the step of causing a reciprocal movement of the at least one of the wiping member and the droplet ejection head in forth and back movements in the vibration direction at least once while the droplet ejection head is moved by a dimension of abutment of the wiping member with the nozzle surface in the head movement direction.

34. The maintenance method as defined in claim 33, wherein an amount of one of the forth and back movements satisfies a condition where an angle between the head movement direction and the vibration direction is not less than 90°.

35. The maintenance method as defined in claim 33, wherein an amplitude A of one of the forth and back movements, a speed Vw of the movement of the wiping member, a speed Vh of the movement of the droplet ejection head, a relative speed V of the movement of the droplet ejection head and the movement of the wiping member which is V =Vh −Vw, the dimension Lw of the abutment of the wiping member with the nozzle surface in the head movement direction, and a frequency f of the vibration satisfy:

$$f > V/Lw; \text{ and}$$

$$A > (Vw+Vh)/(2\times\pi\times f).$$

36. The maintenance method as defined in claim 27, wherein:

the wiping member is a sheet-shaped web having absorbing characteristics with respect to liquid; and the wiping member is pressed by a pressing member which has a surface that deforms elastically and is in contact with the web to press the web against the nozzle surface by pressing the web from a side of the web opposite to a side of the web that is in contact with the nozzle surface.

37. The maintenance method as defined in claim 36, wherein the pressing member includes an elastic roller having a roller shape of which a surface is provided with an elastic member.

38. The maintenance method as defined in claim 36, wherein:

the fine vibration step includes the step of causing a reciprocal movement of the at least one of the wiping member and the droplet ejection head in forth and back movements in the vibration direction at least once while the droplet ejection head is moved by a dimension of abutment of the wiping member with the nozzle surface in the head movement direction; and an amount of one of the forth and back movements is not less than a width of a weave of the web.

39. The maintenance method as defined in claim 36, wherein a static coefficient of friction between the web and the pressing member exceeds a slipping coefficient of friction between the nozzle surface and the web.

40. The maintenance method as defined in claim 27, further comprising:

a raising step of raising the wiping member with respect to the nozzle surface before the fine vibration step; and a lowering step of lowering the wiping member with respect to the nozzle surface after the fine vibration step.

41. The maintenance method as defined in claim 27, wherein in the fine vibration step, the vibration of the one of the wiping member and the droplet ejection head is caused while keeping the wiping member in contact with the nozzle surface.

* * * * *